United States Patent [19]

Hetherington et al.

[11] Patent Number: 4,798,613

[45] Date of Patent: Jan. 17, 1989

[54] SURFACE CLEANING APPARATUS

[75] Inventors: Michael W. Hetherington, Cedar Valley; David P. Garner, Niagara Falls; Allan D. Millman, Toronto, all of Canada

[73] Assignees: Iona Appliances Inc.; Appareils Iona Inc., both of Welland, Canada

[21] Appl. No.: 902,591

[22] Filed: Sep. 2, 1986

[30] Foreign Application Priority Data

Sep. 5, 1985 [CA] Canada ..... 490105

[51] Int. Cl.[4] ..... B01D 19/00

[52] U.S. Cl. ..... 55/52; 55/190; 15/320; 15/344; 15/352; 15/353; 15/385

[58] Field of Search ..... 15/320, 344, 353, 362, 15/385; 55/52, 190

[56] References Cited

U.S. PATENT DOCUMENTS

| | | | |
|---|---|---|---|
| 2,093,748 | 9/1937 | Becker | 15/353 |
| 2,635,277 | 4/1953 | Belknap | 15/353 X |
| 2,639,005 | 5/1953 | Gerstmann | 15/353 X |
| 2,822,061 | 2/1958 | Pettit et al. | 15/353 X |
| 3,939,527 | 2/1976 | Jones | 15/320 X |
| 4,062,085 | 12/1977 | Duncan | 15/353 X |
| 4,114,229 | 9/1978 | Jones et al. | 15/320 |
| 4,137,599 | 2/1979 | Steyer | 15/353 X |
| 4,216,563 | 8/1980 | Cyphert | 15/321 |
| 4,462,137 | 7/1984 | Berfield et al. | 15/353 |
| 4,542,557 | 9/1985 | Levine | 15/344 |
| 4,675,936 | 6/1987 | Rawlins | 15/353 |

*Primary Examiner*—Chris K. Moore

*Attorney, Agent, or Firm*—Weldon F. Green

[57] ABSTRACT

A portable vacuum surface cleaning apparatus for taking up and recovering fluids such as liquids and debris from floors or carpets that includes an elongated circuitous or convoluted passageway having an inlet at one end and an outlet at the other end adapted for communication with a vacuum source and communicating with the recovery chamber through a top access opening in a region thereof intermediately between the inlet and outlet, the elongated passageway including a first section extending from the inlet to an elevated region thereof remote from the inlet and above the recovery chamber portion, an intermediate section in communication with the first section in the elevated region thereof and extending therefrom to overlie and communicate with the top opening of the recovery chamber portion, and a third section in communication with the intermediate section in the region thereof above the top opening and extending therefrom toward the outlet.

52 Claims, 14 Drawing Sheets

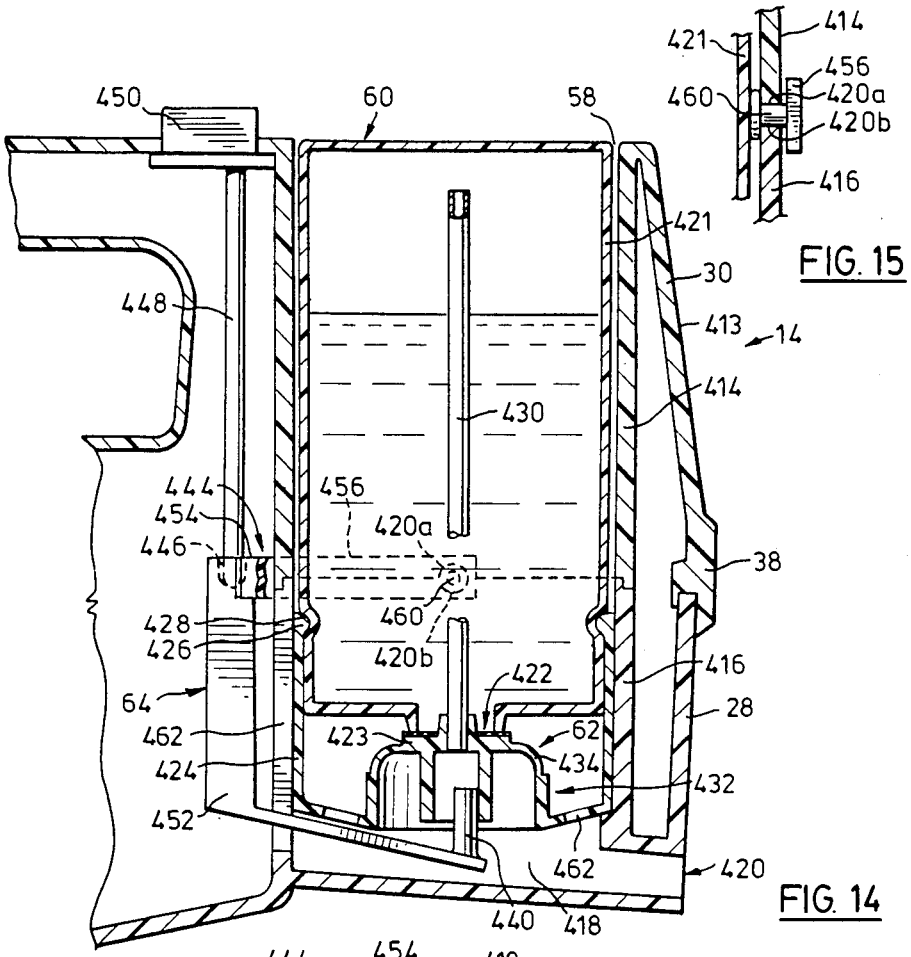
FIG. 15
FIG. 14
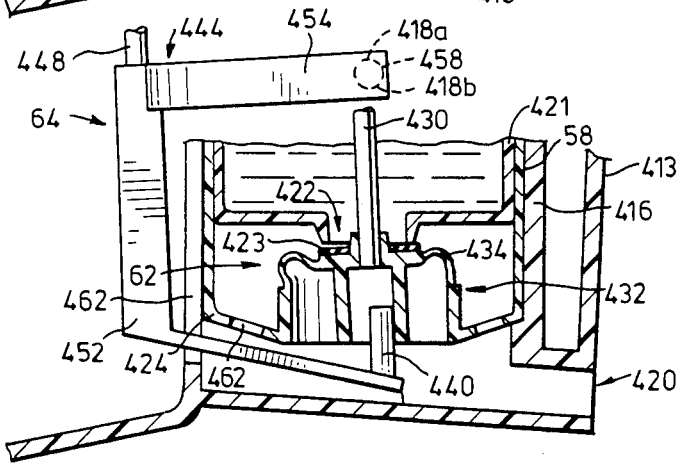
FIG. 16

SURFACE CLEANING APPARATUS

FIELD OF INVENTION

This invention relates to improvements in a vacuum surface cleaning apparatus for taking up and removing fluids such as liquids or spills and debris from flat or textured surfaces such as flooring, carpets or the like.

More particularly, this invention relates to a vacuum surface cleaning apparatus for effectively taking up fluid or spills through an inlet orifice presented by a passageway or channel to which a vacuum source has been applied so as to draw in the fluid or spill through such inlet orifice and convey same part way along the path or channel for delivery into a recovery chamber portion located ahead of the airstream discharge outlet and confining the recovered fluid or spill to such recovery chamber portion against further displacement by the airstream for later disposal.

Still more particularly, this invention relates to improvements in the construction, configuration, arrangement and interconnection of those parts that constitute the housing and framework of the unit, especially those components that define the passageway or channel and associated recovery chamber portion of the vacuum surface cleaning apparatus.

BACKGROUND TO THE INVENTION

Prior proposals using suction or vacuum to take up and collect liquids from flat or textured surfaces such as floors or carpets or the like include those set forth in the following U.S. Pat. Nos.:

2,726,807, 3,530,517, 3,616,482, 3,639,939, 3,919,729 and 3,939,527.

Other U.S. Pat. Nos. such as 3,069,711, 3,699,607 and 4,012,805 provide for the dispensing of fluids or detergents upon floors or carpeted surfaces be treated in conjunction with driven brushes.

Among several alternatives, none appear to be directed to a vacuum surface cleaning apparatus that can be embodied in a compact lightweight hand portable unit easily stored and readily retrieved for immediate and efficient use in taking up and recovering fluids or spilled staining solutions that may mark, discolour or injure floors or carpeted surfaces and safely hold or confine same therein for immediate or later disposal.

Moreover, with such a compact hand portable vacuum apparatus the recovery or collection chamber portion or tank will have limited capacity. The unit therefore must accommodate ready emptying out of the accumulated recovered spills, as well as the flushing out and cleansing of the collection chamber portion or holding tank and related parts if necessary or desired and restored to the operative condition without delay.

Such portable unit preferably also includes an integral motor-driven rotary cleaning implement such as a brush to aid in diluting the fluid or spill or provide a scrubbing action when a detergent solution or other cleanser is to be applied, as well as a source or reservoir of a diluent or neutralizing agent or cleaning fluid for treating the particular fluid spill or staining solution to be dispensed onto the flooring or carpets as required.

OBJECTS OF THIS INVENTION

The principal object of this invention therefore is to provide a vacuum surface cleaning apparatus that can be embodied within a compact lightweight portable unit, yet take up fluids, spills, solutions or other liquid mixtures from surfaces to be cleaned very efficiently and expeditiously conveying them to a collection chamber portion or holding tank therewithin, but not beyond, where they are confined against further displacement and safely held therein for accumulation and later disposal.

Another very important object is to provide such vacuum surface cleaning apparatus in the form of releasably interconnectible components so that the collection chamber portion or holding tank can be readily exposed or withdrawn whereby the accumulated liquid contents can be discharged and the holding tank along with the other related components defining the passageway or channel communicating with the holding tank flushed out or cleansed and reassembled for continued operation or storage.

Another important object is to provide a unit of a strong and durable construction derived from materials and components that resist deterioration or breakdown and that can be manufactured and assembled at relatively low cost and easily maintained or repaired.

It is still another very important object to provide such apparatus and associated equipment in a unit whose shape or configuration not only promotes manoeuverability, efficiency and overall utility, but confers upon the unit a very attractive and distinctive appearance.

FEATURES OF THE INVENTION

The principal feature of this invention resides in providing an elongated passageway or channel for the vacuum surface cleaning apparatus in the form of succeeding discrete sections with appropriately selected internal cross-sectional configurations and dispositions such that fluids such as liquids or spills and debris drawn in with the airstream through the inlet orifice thereof are first accelerated along the extent of the first section, then delivered into the second section wherein the velocity is decreased and along which the recovered liquids or spills are collected and directed under gravity through the top opening of a recovery chamber portion or holding tank disposed therebelow while simultaneously diverting the airstream drawn through the second section and over the top opening of the recovery chamber portion or holding tank into the third section through an entrance located above such top opening and remote from said first section which third section leads to the intake of the exhaust fan or blower unit.

More particularly it is a feature of this invention to so dispose the first section of the elongated passageway or channel such that it inclines from the inlet orifice thereof in a direction upwardly and above the top opening of the recovery chamber portion or holding tank and to so dispose the second section such that it proceeds from the end of the first section remote from the inlet orifice in a direction downwardly and reversely to the first section to communicate with and overlie the aforementioned top opening and to so dispose the third section that the entrance thereinto is presented to the second section adjacent to the lowermost end thereof and above the aforementioned top opening and proceeds in a direction reversely to that of the second section and so achieve a degree of compactness which contributes to hand portability and manoeuverability of the unit.

Moreover, it is a feature to further enhance the attribute of compactness and streamlining of the shape for manoeuverability by arranging for the second section to underlie the first section and in close proximity thereto whereby the extent and degree of inclination of same and overall configuration can be so selected as to optimize the take-up and recovery under gravity of the fluids or spills from the surfaces to be cleaned or treated having regard to the characteristics of the selected exhaust fan or blower.

Still further, the third section can likewise be so disposed that it overlies the second section to incline and flank and/or underlie the first section so that the direction taken by the diverted airstream is substantially the reverse of the direction taken in the second section thereby further contributing to the attribute of compactness and streamlined effect and hence the hand portability and manoeuverability of the overall unit.

Still more particularly, it is a feature to confine or restrict the top opening of the recovery chamber portion or holding tank to the lowermost extent of such second section thereby insuring that the recovered transported liquid or spill will be directed by the walls of the second section and under gravity enter into the recovery chamber portion or holding tank therebelow and exposure to the diverted airstream is minimized so as to substantially eliminate any escape thereof into the third section from such holding tank and on to the inlet of the exhaust fan or blower of the collected fluids held therein.

Still another feature of this invention resides in providing a baffle formation to depend downwardly from the upper wall formation of the second section in the upper region thereof so as to afford a shield extending across the second section for initially diverting and directing the fluid or spill and accompanying airstream impinging thereon downardly from such upper region onto the lower wall formation and thereby effectively prevent any tendency for any fluids or droplets entering the second section from adhering to the surface of the upper wall formation thereof which could be swept with the diverted airstream up into the entrance to the third passageway section and on to the inlet of the exhaust fan or blower.

Another very important feature of this invention resides in providing the first three sections of the elongated passageway and associated collection chamber portion or holding tank in the form of two separable mating components which together in mating relation constitute the front end of the apparatus and which comprises an outer component or shell open to the rear to give access to and receive an inner hollow component in full registration therewithin with the outer component or shell including the first passageway section and the inner hollow component including the second passageway section and recovery chamber portion or holding tank with the outer shell and inner hollow component in full mating relation defining the third passageway section therebetween, which third section opens to the rear access opening of the outer shell.

More particularly, the outer shell including the first passageway section presents the surface engaging inlet orifice for same forwardly and lowermost in proboscis-like fashion and a trailing edge formation surrounding the rear access opening through which the inner hollow mating component enters, which trailing edge formation extends rearwardly therebeyond when the inner hollow component is fully mated, the outer and inner components each having appropriate dimensions and apertures which are adapted to register in sealing engagement to thereby define the three succeeding uninterrupted sections of the elongated passageway and associated recovery chamber portion or holding tank.

Still more particularly, it is a feature of this invention to provide a casing for the rear end of the apparatus that houses and supports the fan structure forwardly therewithin. Further, the upper and lower shell-like sections of the rear end casing present when mated a boss-like protuberance forwardly including a front or forward wall formation bounded by a rearwardly extending peripheral edge formation terminating rearwardly of a contour and extent corresponding to the contour and extent of the inner surface of the trailing edge formation surrounding the rear access opening of the outer shell component of the assembled front end of the unit.

The surrounding edge formation of the boss-like protuberance is adapted to register in sliding fit in a radially extending shoulder formation or seat within and to the extent limited by the shoulder formation and sealingly engage against the aforementioned inner surface of the corresponding trailing edge formation of the assembled front end with the extent of the overlap of the edges limited by the radially extending shoulder formation presented to the trailing edge formation by the rear end casing rearwardly to seat thereagainst, and whereby a sufficient spacing or separation is maintained between the front or forward wall formation of the protuberance and the rear wall of fully registered inner hollow enclosure of the assembled front end to define an airflow passageway leading from the third passageway section, the front wall formation of the protuberance having an aperture therethrough generally centrally thereof leading to the inlet of the exhaust fan or blower and thereby establishing communication between the third passageway section and the exhaust fan or blower inlet with such airflow passageway constituting the fourth section of the elongated passageway.

An appropriate spring-biased latch mechanism and spaced catches and apertures associated with the boss-like protuberance and the trailing edge formation of the front end of the unit releasably sealingly secure the front end to the rear end against separation whereby the front end is supported from the rear end to present the vacuum surface cleaning apparatus forwardly in cantilever-like pivotal fashion in relation to a wheel axis yet readily detachable therefrom for disposal of the contents of the recovery chamber portion or holding tank from within the hollow front end enclosure, the latter including a suitably located discharge opening in the rear wall portion thereof normally sealed by a removable plug.

DESCRIPTION OF THE INVENTION

These and other objects and features will become apparent in the following description of two preferred embodiments of the invention to be read in conjunction with the accompanying sheets of drawings in which.

Figure 1:
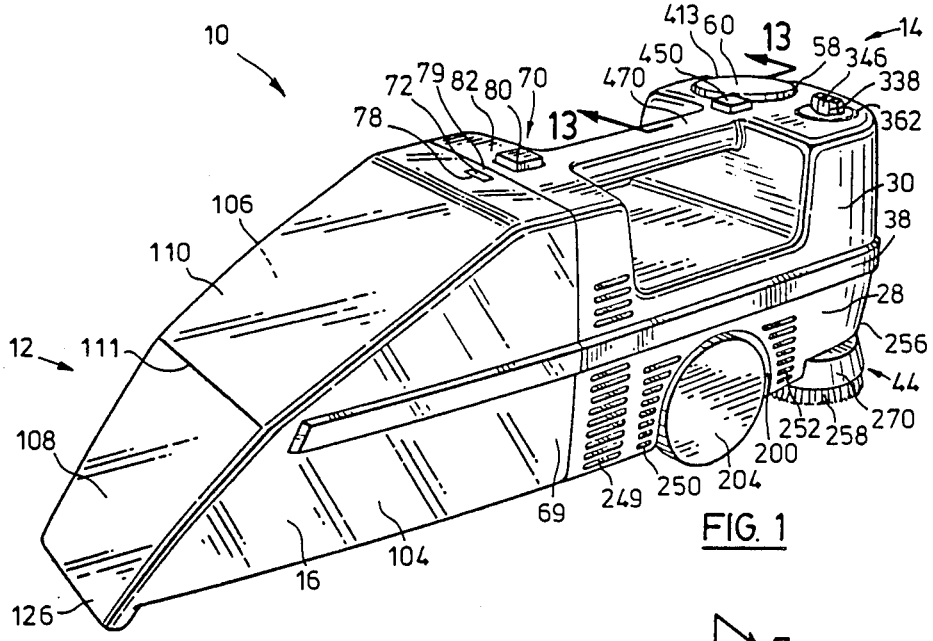
FIG. 1 is a perspective exterior view of one preferred embodiment of a hand portable vacuum surface cleaning unit made in accordance with the invention taken from a point to the right and above the front end thereof.
Figure 2:
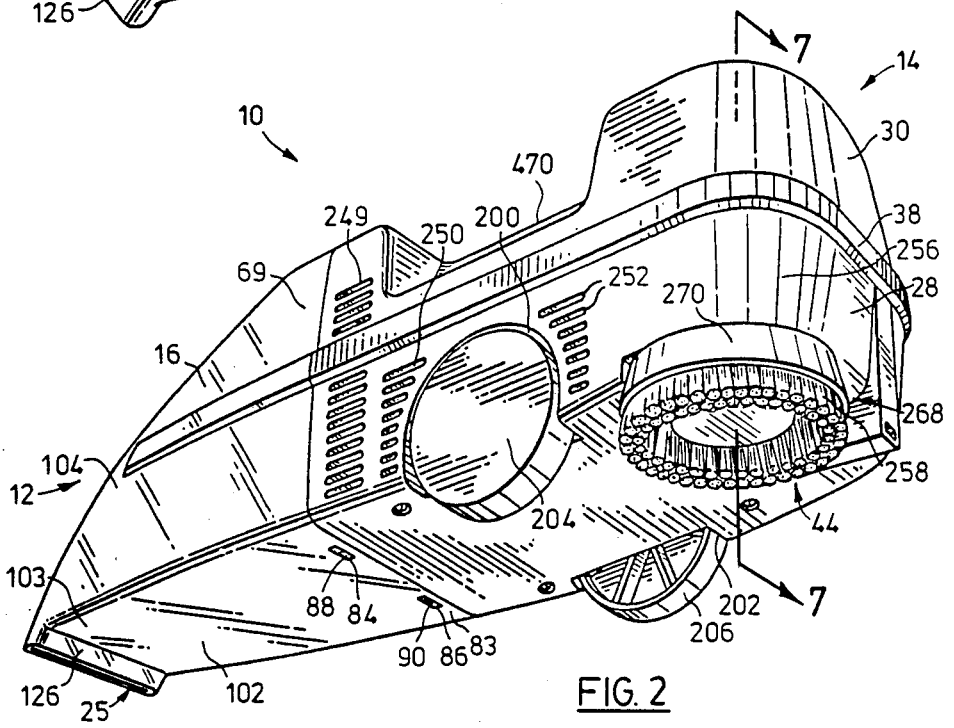
FIG. 2 is a perspective view of the unit illustrated in FIG. 1 but taken from a point to the right and below the rear end thereof as seen in FIG. 1.
Figure 3:
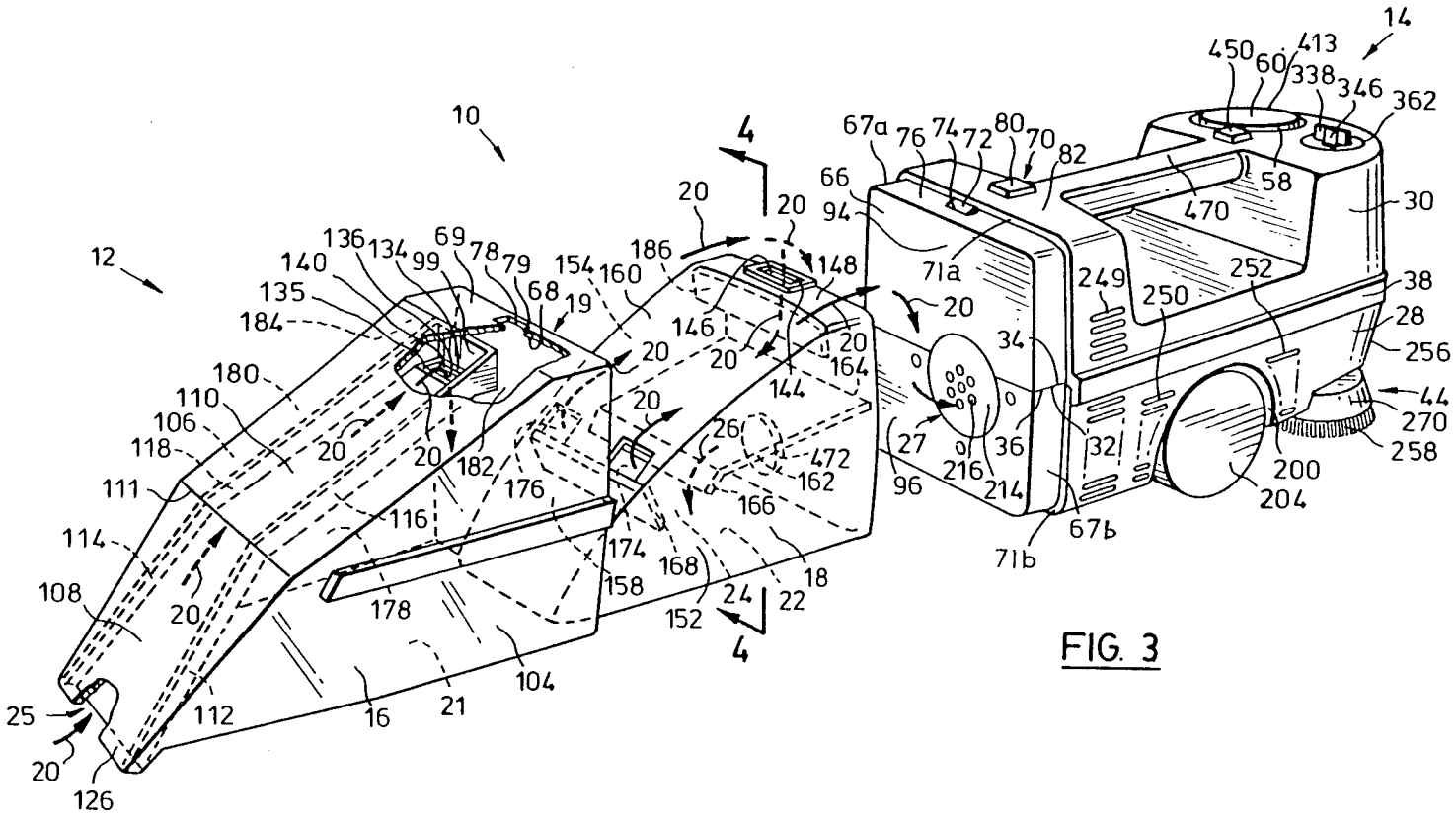
Figure 4:
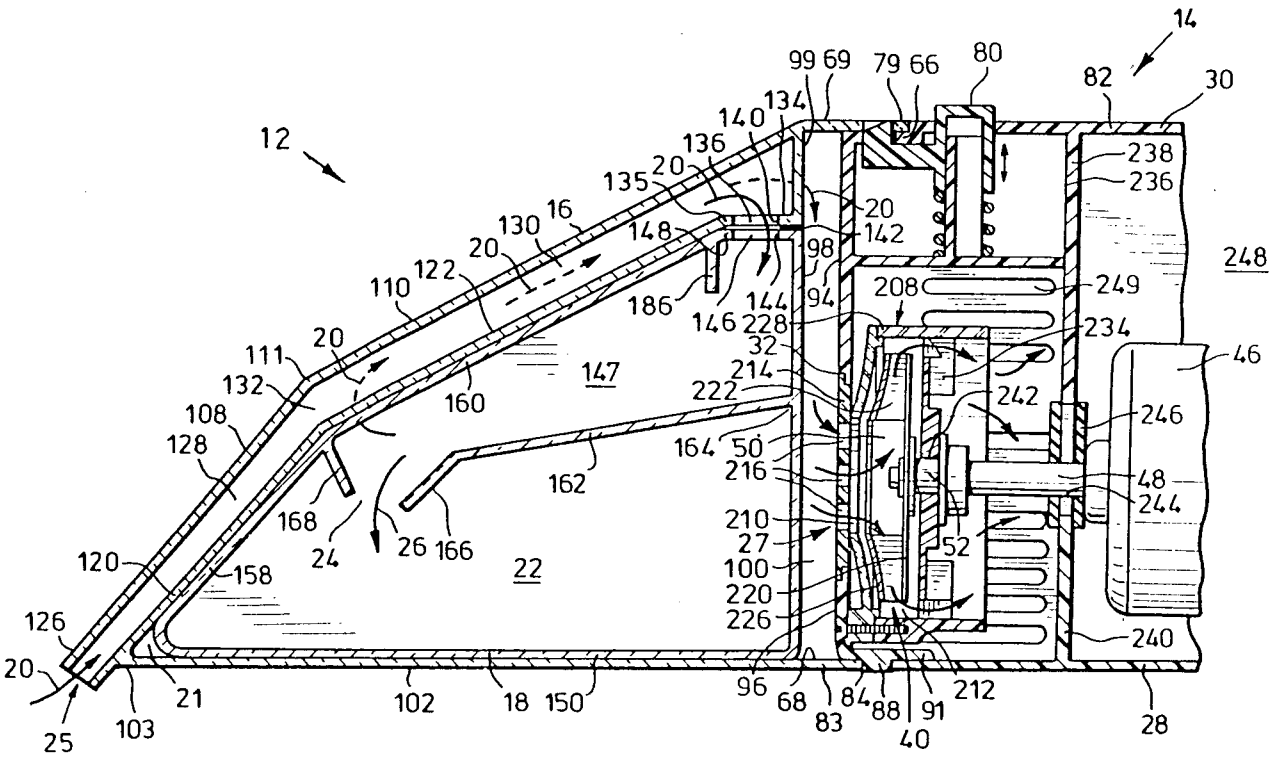
Figure 5:
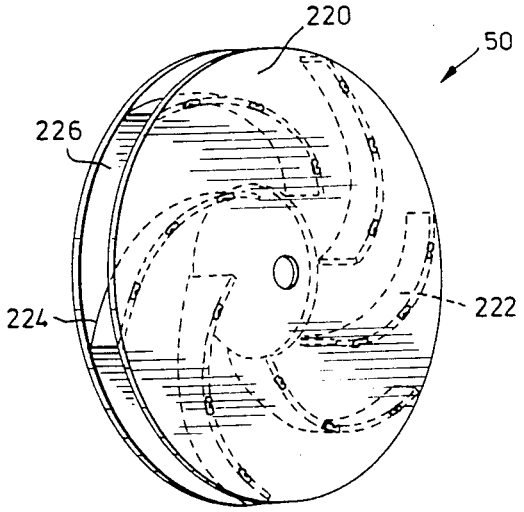
Figure 6:
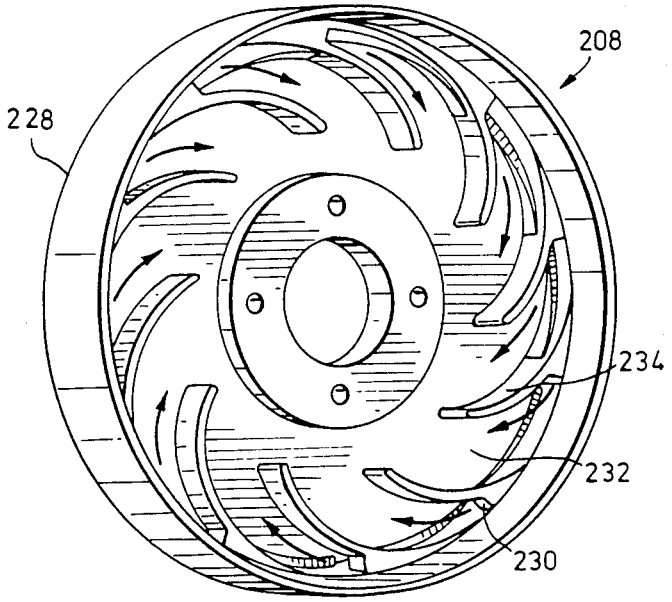
Figure 7:
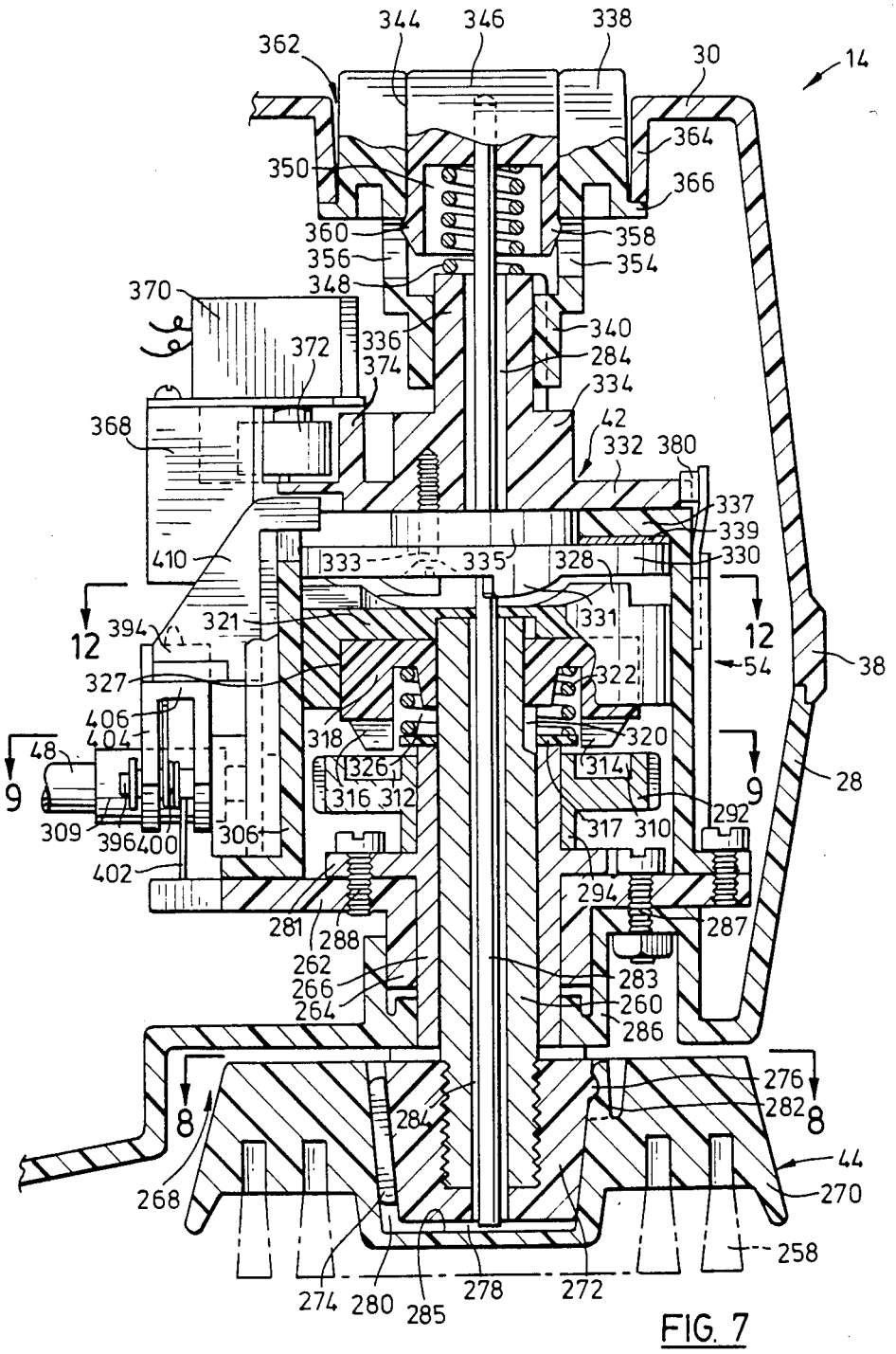
Figure 8:
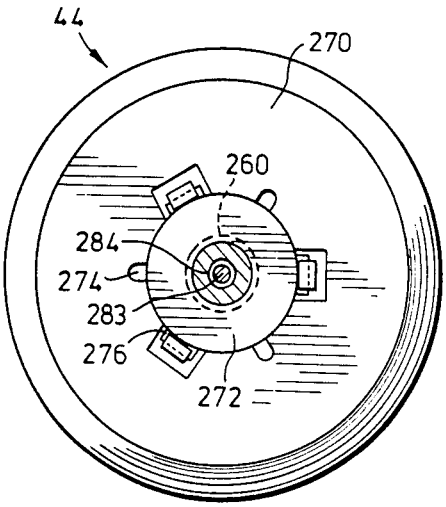
Figure 9:
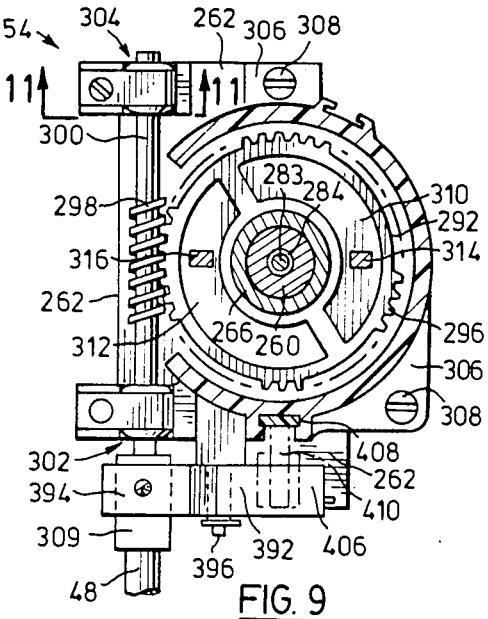
Figure 11:
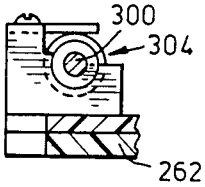
Figure 12:
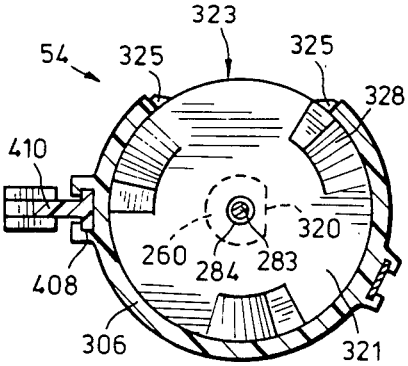
Figure 10:
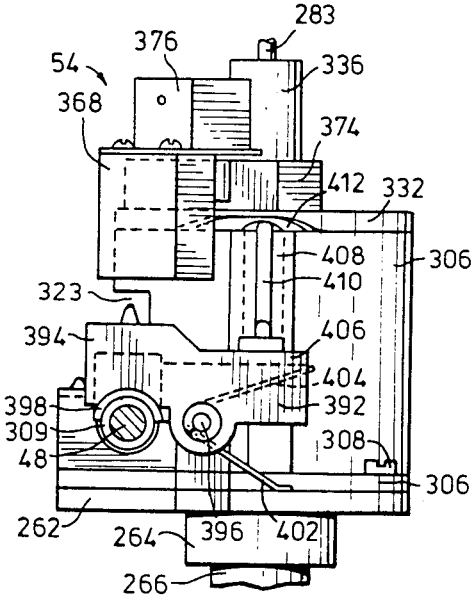
Figure 13:
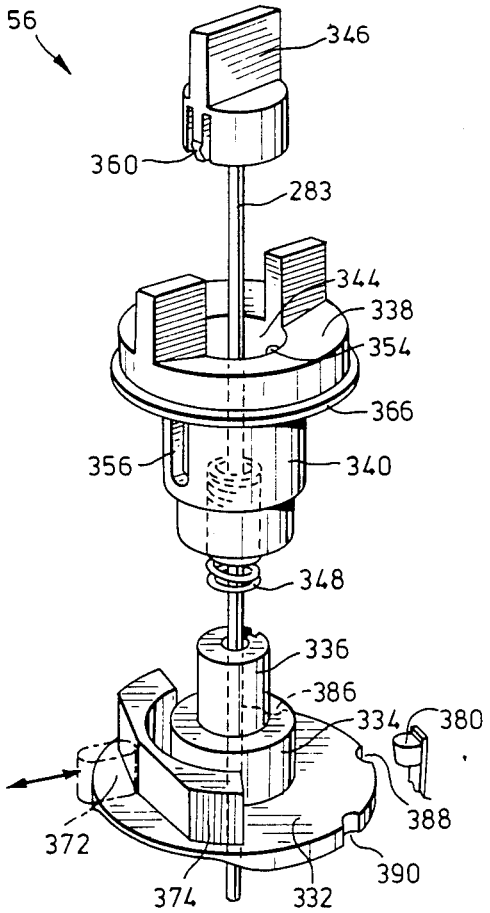
Figure 17:
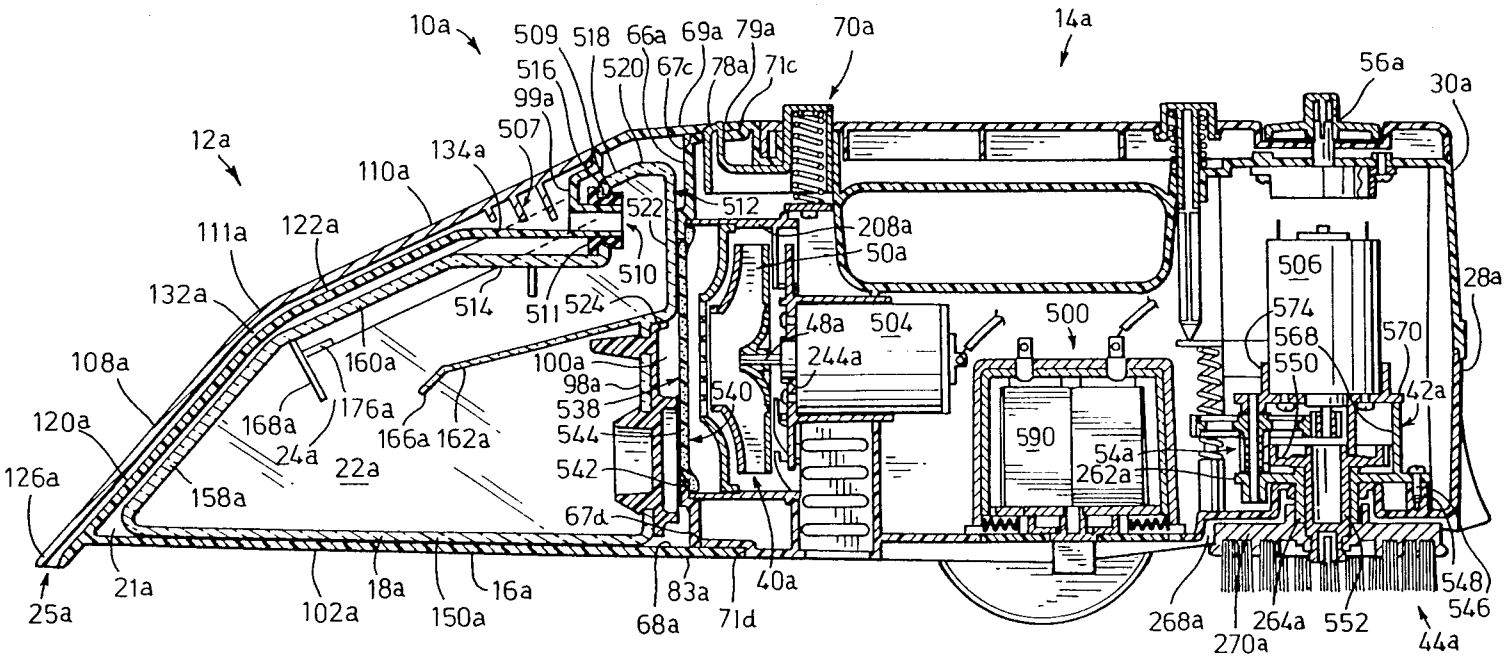
Figure 18:
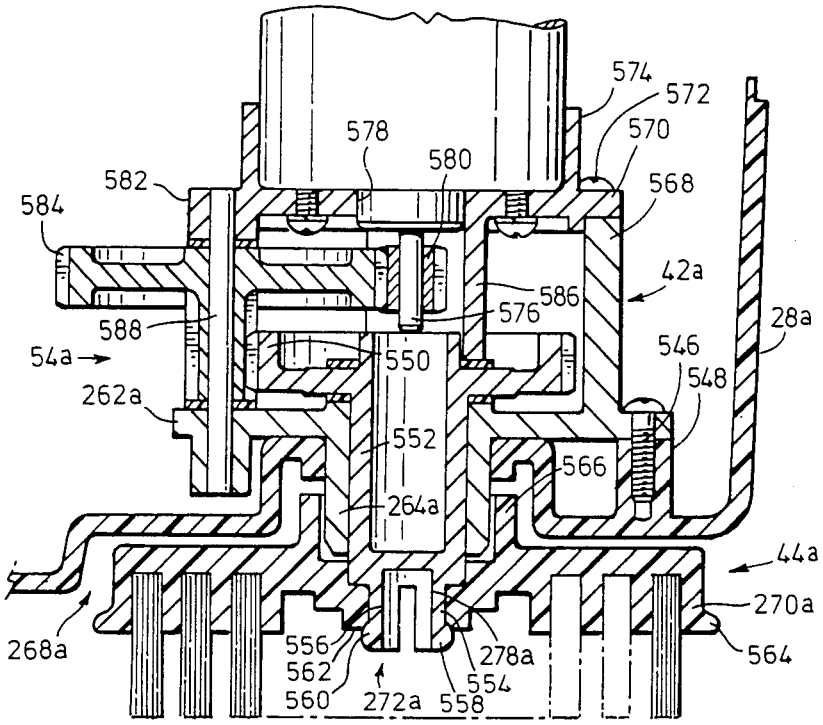
Figure 19:
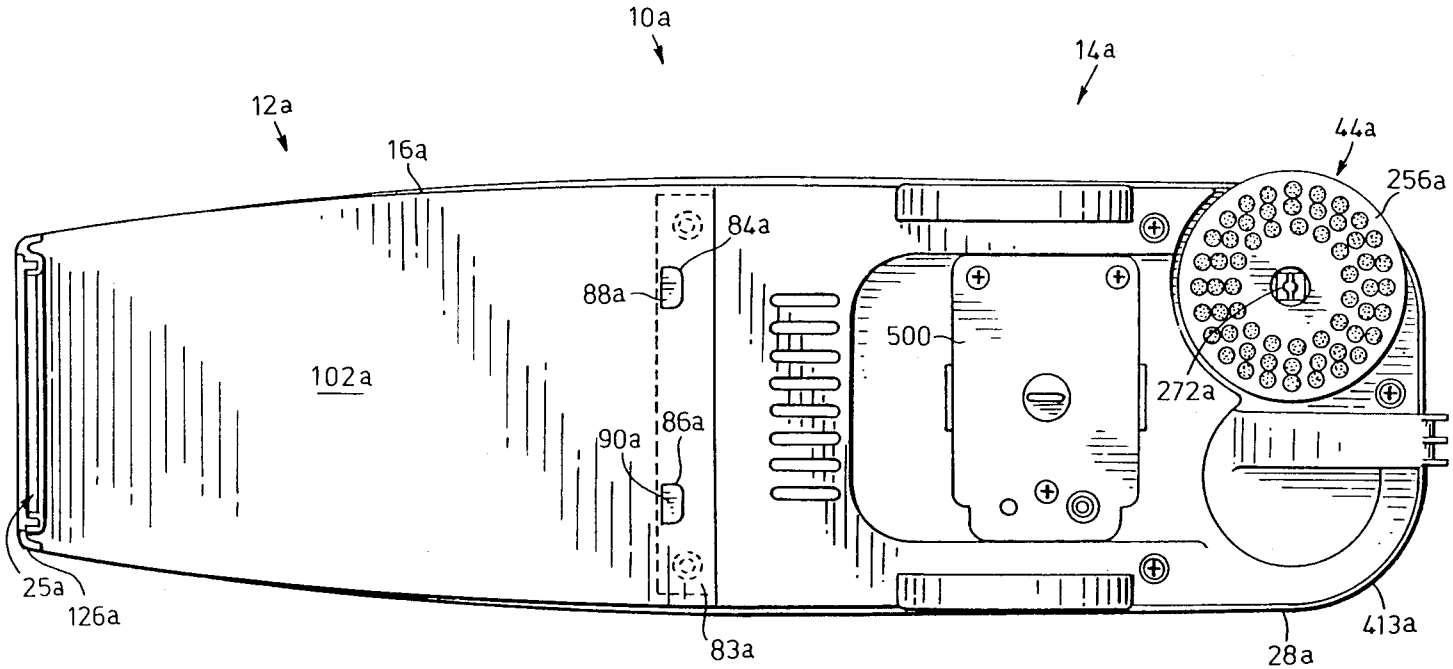
Figures 20, 21:
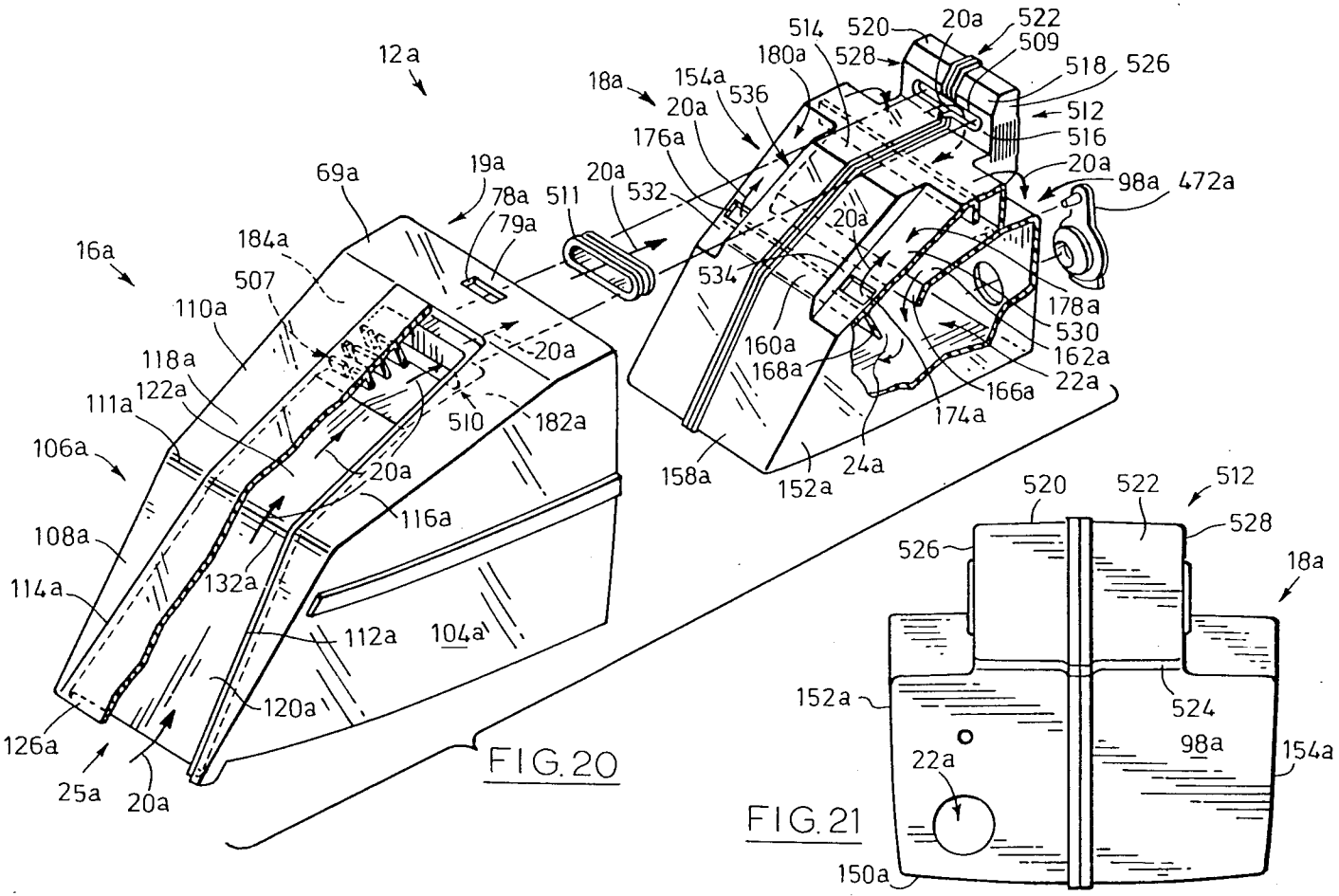
Figure 22:
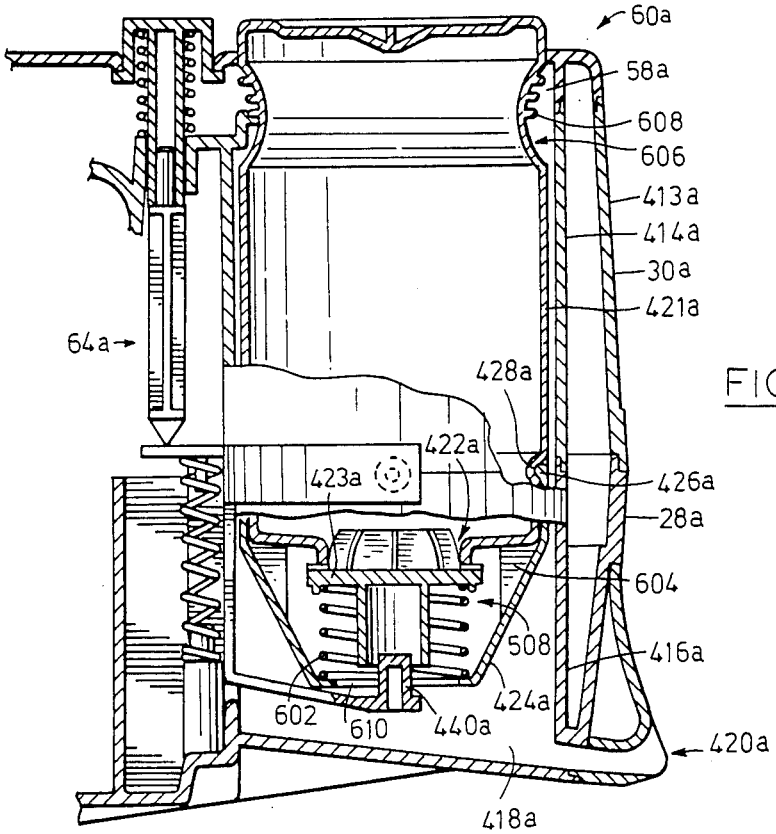
Figure 23:
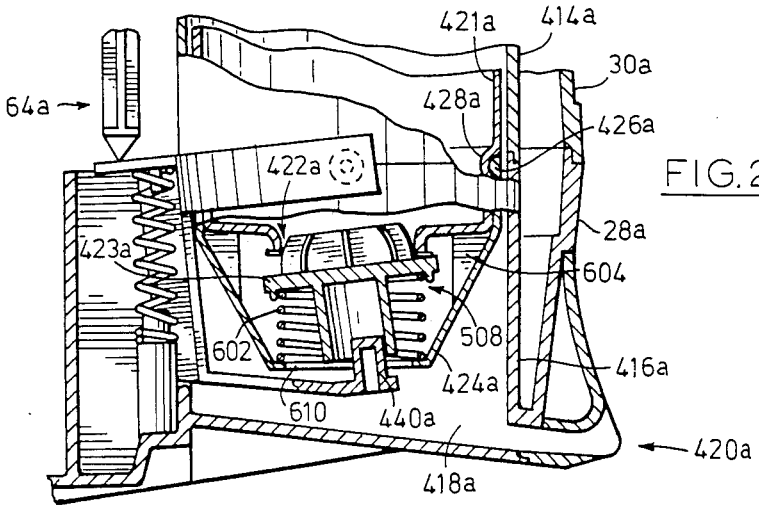
Figure 24:
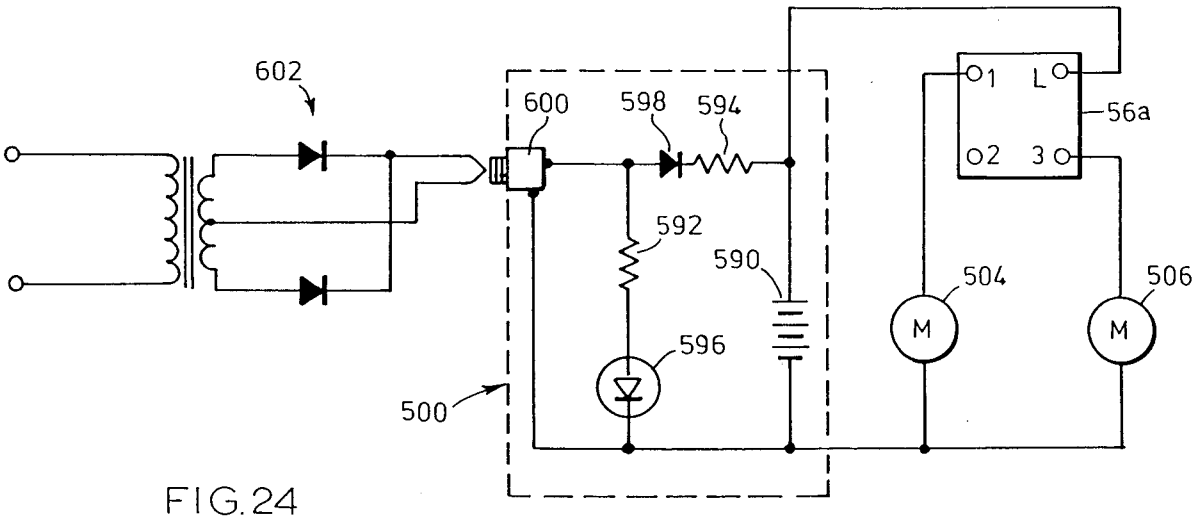

FIG. 3 is a partly exploded perspective view of the unit illustrated in FIG. 1 wherein the front end portion and rear end portion thereof are shown separated and with the outer shell and inner hollow components comprising the front end portion depicted in spaced apart, but aligned, relation to reveal their structures and configurations which in full mating registration define the requisite three discrete sections of the extended and convoluted airflow passageway and associated recovery chamber portion or holding tank;

FIG. 4 is a vertical cross-sectional view of the front end portion and of the housing for the exhaust fan or blower structure of the rear end portion taken along the lnnes 4—4 of FIG. 3, with the remainder of the rear end portion of the unit broken away;

FIG. 5 is a perspective view of the fan or blower impeller of the portable unit of FIGS. 1 to 4 taken from a point to the upper left of the rear face of such impeller;

FIG. 6 is a perspective view of the fan or blower housing for the impeller of FIG. 5 taken from a point to the upper left of the rear wall of the housing;

FIG. 7 is a vertical cross-sectional view of one embodiment of a mounting for the motor-driven rotary brush and a novel switching mechanism for selectively actuating same which are enclosed within the rear end portion of the unit of FIGS. 1 and 2 taken along the lines 7—7 of FIG. 2;

FIG. 8 is a top plan view of the motor-driven rotary brush component of the unit of FIG. 1 with the support therefor depicted in horizontal cross-section taken along the lines 8—8 of the mounting of FIG. 7;

FIG. 9 is a horizontal cross-sectional view taken along the lines 9—9 of the mounting of FIG. 7 to illustrate the relationship of the components of the mounting for selectively connecting the spindle supporting the brush to the motor shaft with the remaining structure broken away;

FIG. 10 is an elevational view of the components of the mounting illustrated in FIG. 9;

FIG. 11 is a vertical cross-sectional view of the bearing and retainer plate utilized in the arrangement illustrated in FIG. 9 taken along the lines 11—11 of FIG. 9;

FIG. 12 is another horizontal cross-sectional view of the structure of the mounting of FIG. 7 taken along the lines 12—12 of FIG. 7 to reveal the configuration of the lower cam element utilized in connecting and disconnecting the spindle of the rotary brush to the motor shaft;

FIG. 13 is a perspective view of the operative components of the switch mechanism of the mounting of FIG. 7 that serve to connect and disconnect the spindle of the rotary brush to the drive shaft of the motor;

FIG. 14 is a vertical cross-sectional view taken along the lines 13—13 of the rear end portion of the unit of FIG. 1 to reveal the structure and disposition of the reservoir presented by such unit and associated lever mechanism including a replaceable receptacle or capsule carrying an integral resilient displaceable dispensing valve therebelow for storing and selectively dispensing a suitable liquid therefrom onto a surface to be cleaned;

FIG. 15 is a another vertical cross-sectional view taken along the lines 15—15 of FIG. 14 with the remaininq structure broken away to reveal the pivotal support provided for the associated lever mechanism;

FIG. 16 is still another vertical cross-sectional view of the reservoir including the receptacle or capsule of FIG. 14 to illustrate the manner in which the integral dispensing valve is displaced so as to open same from the closed position revealed by FIG. 14;

FIG. 17 is a vertical cross-sectional view of the interconnected front end and rear end portions of another preferred embodiment of a hand portable vacuum surface cleaning unit made in accordance with the invention taken along the lines similar to the lines 4—4 of FIG. 3 illustrating the first embodiment, which second embodiment has a generally overall closely similar external shape and configuration to the first embodiment;

FIG. 18 is an enlarged vertical cross-sectional view of the rear end portion illustrated in FIG. 17 disclosing another embodiment of a mounting for the motor-driven rotary brush;

FIG. 19 is a bottom plan view of the second embodiment of the invention illustrated in FIG. 17;

FIG. 20 is a partly exploded perspective view of the front end portion of the second embodiment of the unit illustrated in FIGS. 17 and 19, with the outer shell and inner hollow components depicted in spaced apart but aligned relation to reveal their modified structures and configurations;

FIG. 21 is a rear elevational view of the front end inner hollow component shown in perspective in FIG. 20 taken from a position to the right of such hollow component as viewed in FIG. 20;

FIG. 22 is a vertical cross-sectional view of a modified container or capsule for dispensing a cleaning fluid or the like and associated enclosure which constitutes a slightly modified reservoir for the second embodiment illustrated in FIGS. 17 to 21 inclusive with the remainder of the rear end broken away, and with a modified displaceable valve shown in the closed or sealing position;

FIG. 23 is a part vertical cross-sectional view similar to FIG. 22, but illustrating the modified displaceable valve for sealing the container or capsule in the open position or dispensing mode;

FIG. 24 is a circuit diagram illustrating the connections required for selectively energizing the motor driving the exhaust fan or blower and the motor driving the rotary brush of the second embodiment.

THE FIRST EMBODIMENT

The improved apparatus embodying the invention is generally designated at 10 in FIGS. 1 to 3 inclusive and comprises a front end portion generally indicated at 12 and a rear end portion generally indicated at 14.

Front end portion 12 is comprised of two separable mating components, an outer shell-like component or housing 16 and an inner hollow enclosure 18, each derived preferably from a suitable transparent plastic such as styrene grade SAN H as manufactured by Monsanto.

Front end inner hollow enclosure 18 is contoured to register within the cavity 21 of outer shell 16 in full mating registration therewith through a rear access opening 19 in the manner illustrated in FIG. 3 of the drawings to thereby establish, as revealed by FIG. 4, an elongated generally convoluted internal passageway, indicated by the arrows 20 in FIGS. 3 and 4 and having an inlet orifice 25 at one end foremost and lowermost for taking up fluids such as liquids or spills and debris and an outlet 27 at the other end for exhausting the air, free of fluids or droplets, which passageway is in communication with an intermediate recovery chamber portion or holding tank 22 within hollow enclosure 18 through a transversely extending elongated aperture or top opening 24 in the direction indicated by arrow 26 in FIGS. 3 and 4 wherein all fluids or spills taken up through inlet orifice 25 are delivered and confined or held therein for later disposal.

Rear end portion 14 includes a hollow casing in two mating parts, a lower shell-like component or base portion 28 and upper shell-like component or cover portion 30, each derived from a suitable opaque plastic such as polystyrene which mating parts are interconnected along a horizontal line of juncture 32.

Such line of juncture 32 is established by opposed suitably shaped releasably interengaqeable male female edge formations 34, 36 presented by rear end base portion 28 and cover portion 30 respectively to each other and further reinforced and sealed by an outwardly offset integral flange formation 38 depending from rear end cover portion 30 below and in overlapping relation to the upper edge formation 34 of base 28 and which extends part peripherally therearound as revealed by FIGS. 1 to 3 inclusive.

Rear end cover 30 and base 28 are appropriately shaped or contoured to enclose and suitably reinforced to support and anchor therewithin when disposed in opposed mating relation a suitable centrifugal exhaust fan or blower 40 foremost for exhausting air from the elongated convoluted passageway 20 through an outlet 27 as will be more particularly described, a suitable mounting 42 shown in cross-section in FIG. 7 rearmost for supporting exteriorily presented rotary brush 44 adjacent to and extending partly beyond one corner thereof, and electric motor 46 therebetween, with motor shaft 48 thereof extending fore and aft for driving fan impeller 50 at the forward end 52 and for selectively driving rotary brush 44 through a novel clutch mechanism 54 at the other end which clutch mechanism 54 shown in detail in FIGS. 9 to 12 inclusive is controlled by a novel switching device 56, particularly illustrated in FIG. 13 of the drawings.

Rear end cover 30 rearmost and to the side opposed to mounting 42 is contoured from above to provide a recess or well 58 of generally hollow cylindrical configuration open at the top for the insertion and withdrawal of a removable generally cylindrically-shaped matching hollow container or capsule 60 for a diluent, neutralizinq cleaning fluid, detergent or other solution, constituting one preferred embodiment of reservoir for the unit, which is illustrated in FIGS. 14 to 16 inclusive of the drawings, the container or capsule 60 carrying a depending integral resiliently displaceable valve formation 62 lowermost adapted to be actuated through a novel lever mechanism 64 which will be described in greater detail.

Rear end cover 30 and base 28 at the forward end are shaped and of an extent so as to present when mated a boss-like protuberance 66 which presents upper and lower perimetrally extending wall portions **67*a*, 67*b* respectively which match the respective contour and a selected extent of the inner surface 68 of trailing edge formation 69 surrounding rear access opening 19 of front end shell 16**.

Wall portions **67*a*, 67*b* of protuberance 66 aligned with rear access opening 19 and oriented for entry therewithin upon full registration engage the surrounding inner surface 68 in a snug sliding sealing fit as depicted in FIGS. 1 and 2 and particularly by FIG. 4 with the trailing edge formation 69 seated against the radially extending shoulder formation 71*a*, 71*b*, presented by said mated upper and lower rear cover 30 and base 28**.

A suitable spring-biased latch mechanism generally indicated at 70 in FIGS. 1 and 3 is provided for releasably securing front end 12 to the rear end 14.

Latch mechanism 70 includes latch bolt 72 which normally projects under the bias of the spring, not illustrated, through opening 74 in upper wall segment 76 of wall portion **67*a* so as to engage within an appropriate latching aperture 78 presented uppermost in edge segment 79 of trailing edge formation 69**.

Spring-biased latch bolt 72 is adapted to be displaced downwardly from within latching aperture 78 by depressing associated operator member 80 likewise normally projecting above adjacent uppermost wall portion 82 of rear end cover 30 which details of structure and mounting have not been illustrated as they are known in the field.

Lowermost edge segment 83 of trailing edge formation 69 of front end housing 16 is provided with a pair of spaced apart apertures 84, 86 as best seen in FIGS. 2 and 4 which are adapted to engage over and register with a pair of correspondingly spaced apart and contoured projections 88, 90 respectively depending lowermost from segment 91 of lower wall portion **67*b* of rear end base 28**.

Thus it will be perceived that by first engaging apertures 84, 86 of trailing edge portion 69 of front end formation 16 over lower projections 88, 90 of the rear end base 28 thereby aligning and orienting protuberance 66 with rear access opening 19 and by a swinging movement to move upper aperture 78 in trailing edge formation 69 into overlying registration with depressed spring biased latch bolt 72, latch bolt 72 will upon its release by operator member 80 enter aperture 78 and project upwardly therein and so secure front end 12 and rear end 14 against separation with the front end portion 12 supported from the protuberance 66 in cantilever-like fashion.

Moreover, as will be observed from FIG. 4 of the drawings when front and rear ends 12, 14 are secured together the mated front wall portions 94, 96 of the boss-like protuberance 66 are located uniformly rearwardly from the rear wall portion 98 of front end hollow enclosure 18 and integral depending upper wall portion 99 of front end housing 16 by the shoulder formation **71*a*, 71*b* so as to define a vertically extending passageway 100** therebetween.

It will be appreciated that the front end 12 can be detached from rear end portion 14 simply by depressing operator member 80 to withdraw spring loaded latch bolt 72 from aperture 78 of trailing edge portion 69 and through reverse swinging movement release spaced apart projections 88, 90 from apertures 84, 86.

Front End 12

Front end shell 16 of front end 12 is comprised of a bottom wall portion 102 extending generally hoiizontally in normal disposition and having a somewhat elongated rectangular perimetral configuration tapering forwardly as at 103, spaced apart upright side wall portions 104, 106 respectively of generally right-angled triangular perimetral configuration with the right angle disposed rearwardly, and upwardly and rearwardly inclined forward wall portions 108, 110 respectively of quadrilateral perimetral configuration and intersecting as at 111.

All aforementioned wall portions 102, 104, 106, 108 and 110 are joined or sealed together at their abutting edges and terminate rearmost in the earlier mentioned integral trailing edge formation 69 surrounding rear access opening 19 which includes upper and lower edge segments 79 and 83.

Depending below inclined intersecting forward wall portion 108, 110 respectively and spaced inwardly from the side edges thereof and from each other are an opposed pair of like elongated lower side wall segments 112, 114 and an opposed pair of like elongated upper side wall segments 116, 118 respectively, lower side wall segments 112, 114 converging upwardly to merge with generally uniformly spaced apart upper side wall segments 116, 118 which are joined along their lower edges with lower and upper inclined wall segments 120, 122 respectively which extend in parallel spaced relation to overlying inclined forward wall portions 108, 110 and likewise joined along their abutting edges.

The lowermost extent of inclined forward wall portion 108, lower wall segment 120, and depending elongated upwardly converging side wall segments 112, 114 of front end housing 16 together define the transversely extending narrow inlet opening or orifice 25 which is presented proboscis-like as indicated at 126 in FIGS. 1 to 4 inclusive, disposed forwardly of and below the tapered end 103 of bottom wall portion 102.

The upwardly and rearwardly inclined passageway portion 128 leading upwardly and rearwardly from the inlet orifice 25 defined by forward wall 108, elongated side wall segments 112, 114 and lower wall segment 120 which converge uniformly to the intersection 111 of forward wall portions 108, 110 and are joined with forward wall 110, elongated side wall segments 116, 118 and wall segment 122 which define a continuing upwardly and rearwardly inclined passage portion 130 as an extension of passageway portion 128 with the former having a substantially uniform cross-section, thereby establishing a throat at 132.

Inclined passageway portions 128, 130 constitute the first section or leg, extending from inlet 25 to an elevated region thereof, of the elongated generally convoluted passageway indicated by the arrows in FIGS. 3 and 4 for an airstream to be generated by the centrifugal fan 40 through exhausting air through passageway outlet 27.

Depending upper wall portion 99 carried by the upper segment 79 of trailing edge formation 69 of front end shell 16 effectively closes the upper end of inclined passageway section 130.

A generally horizontal wall segment 134 extending between the lower edge of wall portion 99 and side wall portions 116, 118 and the upper edge 135 of inclined wall segment 122 is suitably apertured as at 136.

Wall segment 134 in the region of the periphery 140 of aperture 136 is provided with a suitable compressible seal 142 which engages the periphery 144 of aperture 146 presented upwardly thereto by a generally horizontally extending wall portion 148 of front end enclosure 18.

In the alternative, horizontal wall segment 134 could be inclined upwardly and constitute an extension of upper wall segment 122. Likewise, wall 148 could be inclined upwardly and both wall segment 134 and wall 148 present their respective apertures to one another and with their peripheries in sealing engagement in the manner explained.

Thus the airstream drawn from the atmosphere through inlet orifice 25 and through passageway portions 128, 130 passes through apertures 136, 146 into the second passageway section or leg 147 of convoluted passageway 20 which has the effect of reversing the initial upwardly and rearwardly direction imparted to the airstream to be generated by centrifugal exhaust fan 40 from inlet orifice 25 upwardly and rearwardly.

Moreover the depending wall portion 99 serves as a first baffle diverting and directing the airstream impinging upon the inner surface thereof downwardly through mating apertures 136, 146 into the second passageway section or leg 147 of elongated convoluted passageway 20.

Front end hollow enclosure 18 in addition to wall portion 148 and rear wall 98 includes a bottom wall portion 150 extending generally horizontally in normal disposition and having a somewhat elongated rectangular perimetral configuration tapering forwardly to match the perimeter of bottom wall portion 102 of front end shell 16, spaced apart upright side wall portions 152, 154 respectively of somewhat right angled triangular perimetral configuration with the right angle disposed rearwardly corresponding in outline to upright wall portions 104, 106 of front end shell 16 and upwardly and rearwardly extending intersecting inclined forward wall portions 158, 160 respectively likewise corresponding to forward wall portions 108 and 110 of front end housing 16.

The wall portions of front end hollow enclosure 18 are joined along their respective perimetral edges to give an overall external shape which generally matches the inner boundaries of cavity 21 presented by front end shell 16 so as to derive support from same.

Front end hollow enclosure 18 so defined is further provided with an internal wall segment 162 which extends transversely between side wall portions 152, 154 and is supported from the rear wall portion 98 along a horizontal line of juncture 164 therewith generally intermediately of the vertical extent of same and is uniformly forwardly and downwardly inclined terminating forwardly lowermost in a more sharply forwardly and downwardly inclined lip formation 166 constituting one segment of the restricted top opening 24 of the recovery or holding tank 22.

An opposed wall segment or lip formation 168 projects outwardly from the intersection of the forward wall portions 158 and 160 of hollow enclosure 18 and is reversely angled downwardly rearwardly in opposed spaced relation to lip formation 166 as well as substantially at right angles to the plane of inclined forward wall portion 160 and extends transversely thereacross between upright side wall portions 152 and 154 constituting another segment of the aforementioned restricted top opening 24.

The selected separation between lip formations 166 and 168 and end abutting wall portions 152, 154 of hollow enclosure 18 define the transversely extending elongated relatively narrow or restricted aperture 24 which serves as the top opening or entrance into recovery chamber portion or holding tank 22 located below and projecting forwardly beyond internal wall segment 162 and aperture 24. Thus, with recovered fluid or spills deposited in the holding tank 22 the mass thereof is distributed so as to enhance the manoeuverability of the unit.

It will be noted however that forwardly and downwardly inclined wall segment 162 and the associated lip formation 166 as well as opposing wall segment or lip formation 168 also serve to substantially completely separate second passageway section 147 from the recovery chamber portion or holding tank 22. Thus the airstream traversing the second passageway section 147 to be diverted into the third passageway section disposed thereabove is prevented from impinging directly upon the surface of any fluid or spill collected in recovery chamber portion or holding tank 22 which would have the tendency to take up fluid from such surface into the airstream and convey it into and along the third passageway section to outlet 27 and into the fan 40.

The upper forwardly inclined wall portion 160 of hollow enclosure 18 is provided with a pair of spaced apart apertures 174, 176 therein as best seen in FIG. 3 of the drawings.

Apertures 174, 176 flank the passageway portion 130 of the first passageway section or leg and serve as an entrance to the third passageway section which includes the pair of channel formations 178, 180 on either side of first passageway portion 130.

The third passageway section or leg in the preferred embodiment is defined only upon the full mating registration of enclosure 18 within shell 16 by those segments of inclined upper wall portion 110 of front end shell 16 on either side of first passageway portion 130, the upper wall portions of side walls 104, 106 of front end shell 16, side walls 116, 118 of passageway portion 130 and portions of upper wall 160 of enclosure 18 on either side of passageway portion 130 and are as at open ends 182, 184 for communication at an elevated region thereof with vertically extending passageway 100 constituting the fourth section of the elongated passageway 20.

Preferably within second passageway section or leg 147 a baffle formation 186 is provided depending downwardly below upper inclined wall portion 160 immediately forwardly of aperture 146 and extending transversely thereacross and supported from upright side wall portions 152, 154 and in spaced relation above downwardly inclined wall segment 162.

Baffle formation 186 in such position serves as a shield to further divert and direct the fluid and droplets and the airstream impinging thereon from the upper region downwardly as the direction of same is reversed from their initial direction in passing from the first passageway section to the second passageway section 147 and then reversely into the third passageway section, which barrier presented by the baffle formation tends to prevent any adherence to the inner surface of the inclined upper wall 160 of any fluid or droplets that could be swept therefrom by the airstream in traversing second passageway section 147 and passing into the third passageway section through the entrance defined by apertures 174, 176.

It is also to be observed that the disposition and transverse extent of the lowermost wall segment constituting lip formation 168 beyond entrance apertures 174, 176 effectively establishes not only a drainage surface leading into the holding tank 22, but deflects and diverts the airstream impinging thereon drawn thereover upwardly towards entrance apertures 174, 176 and directs adhering droplets or fluid under gravity into holding tank 22.

The sliding fit surface engagement established between the surrounding wal portions *67a, 67b*, of protuberance 66 and inner surface 68 of trailing edge formation 69 of front end enclosure 16 may be improved by providing a suitable gasket therebetween in order to substantially eliminate any likelihood of drawing air from the atmosphere through such joint into fourth passageway section or leg 100 which would seriously impair the operation of the apparatus.

It is to be observed having regard to FIGS. 3 and 4 of the drawings particularly, and the dimensions and proportions assigned to the succeeding first, second, third or fourth passageway sections respectively, as well as to recovery chamber portion or holding tank 22 that their cross-sections alter in the following sequence, namely: converging from inlet orifice 25 to the throat portion 132, substantially constant from throat portion 132 to aperture 136, increased from orifice 136 to below baffle formation 186 and thereafter converging forwardly and downwardly therefrom toward the top opening or drainage aperture 24, generally constant from apertures 174, 176 defining the entrance into the third section to outlet openings 182, 184; and of generally increased cross-section from openings 182, 184 to outlet 27.

Variations in length and cross-section can be introduced without altering the preferred embodiment of the concept inherent in the elongated circuitous passageway 20.

Rear End 14

The lower casing or base 28 of rear end 14 is shaped so as to present intermediately of the longitudinal extent of same recesses 200, 202 opening outwardly to each side and downwardly respectively and having a part cylindrical configuration to have opposed surface engaging wheels 204, 206 therein respectively.

Cylindrically-shaped surface engaging wheels 204, 206 follow the contour of recesses 200, 202 and are mounted for rotation on suitable axles anchored in the inner wall portions of the recesses, not illustrated, in transverse alignment at an elevation and of a radial dimension sufficient to provide adequate clearance for brush element 44 and so avoid any drag or restraint on apparatus 10 when disposed upon a supporting surface to take up fluid through the forwardly projecting inlet orifice 25 of extended passageway 20.

Moreover, with this arrangement when apparatus 10 is operated to rotate brush element 44, the proboscis-like extension 126 of front end 12 presenting inlet orifice 25 will likewise substantially clear the supporting surface upon depressing the rear end 14 in the region of brush element 44 to urge the bristles thereof downwardly against the supporting surface or textured carpet which in pivoting about the axis defined by the axles of wheels 204, 206 achieves a better contact and promotes more effective cleaning action.

It also will be noted that the transverse width of wheels 204, 206 is selected to correspond to the depth of recesses 200, 202 measured axially in order that the wheels are at least flush or set back within the side wall portions of the rear casing base 28 surrounding them to streamline the apparatus and so achieve an overall uniform minimum width therealong, which narrowness may be a factor in effectively penetrating narrow passages between furniture without moving same.

Centrifugal fan 40 mounted forwardly within and secured to casing base 28 of rear end 14 is so disposed that the axis of rotation of impeller 50 defined by the motor shaft 48 is offset to one side but generally parallel to the central longitudinal axis of base portion 28 to accommodate the mounting 54 for rotary brush 44.

The housing 208 for centrifugal fan 40 includes a central inlet opening 210 for impeller chamber 212 and in alignment with an apertured plate 214 releasably mounted within the plane of wall portions 94, 96 of protuberance 66, apertures 216 of plate 214 constituting the outlet 27 of extended passage section 20 and having sufficient area to establish efficient flow communication between inlet orifice 25 of extended passageway 20 and impeller chamber 212.

Impeller 50 of centrifugal fan 40 is derived from a suitable disk-like rear wall portion 220 and an associated set of arcuate blades 222 supported along their forward edges 224 by a part conical annular ring 226.

According to this arrangement impeller blades 222 of impeller 50 upon rotation draw in air through inlet opening 210 of impeller chamber 212, defined by fan housing 208 and shroud 228 spaced rearwardly of impeller 50, and by a substantially tangential scooping action deliver the air to peripheral openings 230 in shroud 228 which are uniformly circumferentially spaced therearound and lead into a series of inwardly spiralling channels 232 on the side of the shroud 228 opposed to the impeller chamber 212 which channels 232 are defined by a plurality of curvate vanes 234 supported from the inner surface of the surrounding fan housing 208 and from the rear surface of shroud 228.

Fan chamber 236 is defined by the surrounding mating wall portions of base 28 and cover 30 of the rear end casing and includes forwardly mating wall portion 67*a*, 67*b* and wall portions 94, 96 of protuberance 66 and rearwardly of fan housing 208 a partition wall derived by inwardly disposed mating upper and lower wall segments 238, 240.

Both shroud 228 and lower mating partition wall segment 240 are provided with suitable openings 242 and 244 respectively through which motor shaft 48 extends, opening 244 including a surrounding appropriate packing or gasket 246 to seal such latter opening against the escape therethrough into the motor chamber 248 of any air delivered to fan chamber 236 by impeller 50.

The surrounding wall of fan chamber 236 is provided with a series of elongated spaced apertures 249 so disposed and of sufficient number as to efficiently discharge the air delivered thereinto by impeller 40 from the extended convoluted passageway 20 into the atmosphere and in a direction outwardly from the casing.

Motor chamber 248 for housing motor 46, which motor is supported somewhat centrally within casing base 28 and secured thereto generally between wheel recesses 200, 202, is likewise provided with a series of elongated discharge and inlet apertures 250, 252 respectively fore and aft of wheel recesses 200, 222 respectively.

A suitable fan structure not illustrated is mounted within motor casing 46, the fan impeller of which is adapted to be driven by motor shaft 48, and the intake and discharge so positioned as to preferably draw atmospheric air in through the rearwardly disposed inlet apertures 252 and discharge the air out of forwardly located outlet apertures 250 and to thereby achieve requisite cooling of the electric motor 46 while operating, all in a well known manner.

It will be appreciated that by discharging the cooling air of motor chamber 248 through forwardly located discharge apertures 250 ahead of wheel recesses 200, 202, the paths of the discharged cooling air and the air discharged from fan chamber 236 are next adjacent and proceed outwardly from the casing ensuring that little likelihood exists of the fan chamber discharge air directly entering the motor chamber 248 through rearwardly located inlet apertures 252.

Brush element 44 as perceived from FIGS. 1, 2 and 3 respectively is disposed so as to project partly outwardly beyond and below adjacent rear corner 256 of casing base portion 28 in order that the bristles 258 can readily enter corners or contact the edges of flooring or carpets adjacent baseboards, cabinets, furniture or the like.

The mounting 42 for brush element 44 is supported from a vertically disposed rotary shaft section 260 substantially offset from the longitudinal axis of the apparatus and as a consequence motor 46, associated shaft 48 including centrifugal fan 40 likewise are similarly offset to a lesser degree to simplify the requisite driving connections between shaft 48 and vertically disposed rotary shaft section 260 as will be described.

Mounting 42 illustrated partly in cross-section in FIG. 7 includes a molded base element 262 with an integral centrally depending tubular extension 264 serving as a support for an inner sleeve element 266 surrounding and supporting rotary shaft section 260 in sliding fit and orienting same vertically for rotation therewithin.

Rear casing base section 28 in the region of the corner 256 is appropriately contoured on the underside as at 268 to provide a recess wherein the bristle supporting block 270 of brush 44 is disposed, which block 270 is releasably secured to the lowermost end of rotary shaft section 260 by means of a tapered plug 272.

Tapered plug 272 derived from suitable plastic such as polyethylene includes circumferentially spaced generally longitudinally extending radial projections 274 as well as plurality of circumferentially spaced projections or keepers 276 below the upper edge thereof.

Block 270 of brush 44 is provided with a central opening 278 so tapered and provided with generally longitudinally and radially projecting slots 280 as to match the shape of plug 272 and radial projections 274 whereby a pressure fit therebetween can be achieved.

Block 270 within the upper perimeter of central tapered opening 278 is provided with a plurality of recesses 282 that are so spaced as to receive and anchor projections or keepers 276 therewithin upon proper orientation by entering radial projections 274 of plug 272 within slots 280 and urging block 270 upwardly into full registration with plug 272.

Separation of block 270 from plug 272 is accomplished by a displaceable rod element 283 mounted within the central bore 284 of rotary shaft section 260 and extending upwardly therebeyond which upon displacement downwardly strikes the central lower wall portion 285 of block 270 dislodging same from plug 272.

The upper support for rod 283 will be described in relation to the switching device 56.

The central tubular extension 264 of the base element 262 and inner sleeve element 266 are adapted to register within an apertured tubular seat portion 286 presented by rear casing base section 28 centrally of brush recess 268, sleeve element 266 including a radially extending annular anchoring portion 281 disposed in overlying relation to base element 262 which is secured thereto by a suitable threaded fastener as indicated at 288.

Base element 262 and rear casing base section 28 are likewise secured together by a suitable threaded bolt and nut as indicated at 287 which permanently anchors central tubular extension 264 within tubular seat portion 28 presented by rear casing and through which the lower end rotary shaft section 260 projects.

Sleeve element 266 extending above annular portion 281 presents an outwardly disposed cylindrically shaped bearing surface for a gear wheel element 292 including a central apertured hub portion 294 mounted for rotation upon sleeve element 266 and seated lowermost upon the inner region of radially projecting annular anchoring portion 281 thereof.

Gear wheel element 292 presents throughout its outer circumference generally axially extending appropriately shaped gear teeth 296 adapted to engage worm gear 298 presented centrally of shaft section 300 supported within spaced apart bearing formations 302, 304 mounted upon and integral with base element 262.

A surrounding generally tubular support structure 306 is carried by and anchored to base element 262 by appropriate threaded fasteners 308 as indicated in FIGS. 9 and 11.

Worm gear shaft 300 is adapted to be permanently coupled to the rearward extension of motor shaft 48 as at 309 so that upon energization of motor 46 to drive fan impeller 40 gear wheel element 292 will be driven through worm gear 298 of shaft section 300.

Gear wheel element 292 is provided with a pair of radially spaced diametrically opposed upwardly opening recesses 310 and 312 which are shaped to receive in mating registration like radially spaced diametrically opposed dogs 314, 316 respectively depending from an axially displaceable clutch element 318.

Clutch element 318 is apertured centrally thereof so as to slideably receive the upper portion of rotary shaft section 260 therewithin and suitably keyed as at 320 thereto so as to impart rotation to shaft section 260 upon engagement of dogs 314, 316 within recesses 310, 312 in gear wheel element 292 upon displacement downwardly of clutch element 318 imparted by displaceable overlying bearing support 321.

Clutch element 318 and overlying associated bearing support 321 are normally urged upwardly to hold dogs 314, 316 out of registration with recesses 310, 312 in gear wheel 292 by a suitable coiled spring element 322 surrounding shaft 260 and extending between an annular support element 317 seated upon upper end of bearing sleeve element 266 and downwardly opening annular recess 326 presented by clutch element 318.

As best seen in FIG. 7 clutch element 318 is also urged by coiled spring 322 to permanently register within an annular bearing recess 327 presented by overlying bearing support 321 which supports clutch element 318 from above for rotation therein.

Only upon displacement downwardly against the force exerted by spring 322 to register dogs 314, 316 within gear wheel recesses 310, 312 will rotation be imparted to clutch element 318 and associated rotary shaft section 260.

Overlying bearing support 321 is provided on its upper surface as illustrated in FIG. 12 with three integral equidistantly circumferentially spaced cam followers 328.

Bearing support 321 as indicated is supported for displacement longitudinally of rotary shaft section 260 within surrounding supporting structure or housing 306, but is held against rotation by associated spaced radial projections 325 engaging within vertically extending slotted portion 323 presented by surrounding support structure or housing 306 to guide same throughout axial displacement to be imparted thereto by overlying cam support element 330.

Overlying cam support element 330 is likewise mounted for rotation within support structure or housing 306 upon an axis coincident with the vertical axis of rotary shaft section 260 and presenting therebelow three circumferentially equidistantly spaced appropriately contoured cam projections 331.

Cam projections 331 are adapted to engage cam followers 328 upon appropriate rotation of cam support element 330 and thereby impart in the well known manner of uniform downward displacement of bearing support 321 together with associated clutch element 318 whereby with dogs 314, 316 registered within recesses 310, 312 of gear wheel 292 rotation can be imparted to rotary shaft section 260 and brush 44.

Cam support element 330 is apertured centrally so as to pass rod element 283 upwardly therethrough and includes a projecting annular boss 335 to serve as a spacer to accommodate the inwardly extending annular top wall portion 337 against which the upper peripheral surface of cam support element 330 is adapted to bear but separated by a suitable bearing plate 339 and is in turn carried by an overlying disk-like element 332 by securing same thereto by suitable threaded fasteners as indicated at 333 which extends through boss 335.

Disk-like element 332 includes integral annular portions 334, 336 upstanding therefrom, annular portions 334 and 336 being likewise apertured centrally so as to pass rod element 283 upwardly therethrough and therebeyond.

Uppermost annular portion 336 presented by disk-like element 332 is provided with a knob-like element 338 presenting a central depending tubular portion 340 therebelow downwardly in overlying telescoping relation with the annular portion 336 which latter portion is keyed to tubular portion 340 in order that rotational movement may be imparted to disk-like element 332 and associated cam supporting element 330 by rotating knob-like element 338 engaging dogs 314, 316 in recesses 310, 312 of gear wheel 292 and reversely.

Knob-like element 338 is apertured centrally as at 344 and supports a fitting 346 therewithin in sliding fit for vertical displacement of rod element 283, the upper end of which is securely anchored within fitting 346.

A suitable coiled spring 348 disposed within downwardly opening recess 350 presented by fitting 346 and surrounding the upper portion of rod element 283 to bear against the upper surface of annular portion 336 of disk-like element 332 urges fitting 346 and associated rod element 283 upwardly.

Knob-like element 338 is provided with diametrically opposed longitudinally extending slots as at 354, 356 into which opposed projections 358, 360 of fitting 346 extend. It will be perceived that upon depressing fitting 346 against the force exerted by spring element 348, fitting 346 and associated rod element 283 is guided by opposed longitudinally extending slots 354, 356 in that descent, with rod element 283 at the lower end contacting the lower wall portion 285 of opening 278 of the block 270 to displace same downwardly and disengage same from plug 272.

It is also to be noted that knob-like element 338 and associated fitting 346 project through opening 362 in casing cover 30 wherein upper casing 30 is contoured to present a surrounding downwardly projecting edge formation 364 against which annular flange 366 presented by knob-like element 338 bear under the force exerted by spring element 348.

Support formation 306 includes a projection 368 extending radially outwardly from the region of the upper annular surface thereof to serve as a support for an electrical switch 370 for energizing electric motor 46.

Electrical switch 370 includes a spring biased switching element 372 which is adapted to be displaced by a cam 374 upstanding from disk-like element 332 upon rotation thereof as best seen in FIG. 13.

Rotational movement imparted to disk-like element 332 under the application of torque thereto by knob-like element 338 is limited by an internal stop formation, not illustrated, which includes a projection upstanding from annular top portion 337 which is adapted to engage within an overlying part annular slot presented to the projection by the overlying disk-like element 332.

Thus, upon rotational movement imparted to disk-like element 332 the aforementioned projection in one direction will at the end of the part annular slot prevent further rotational movement and so establish one limit position.

Likewise, through reverse rotational movement the projection moving into the other end of the part annular slot will limit rotational movement in that direction and so establish a second limit position.

A leaf spring detent 380 upstanding from and secured within side wall of support structure 306 is urged against the periphery of disk-like element 332 to register successively within circumferentially spaced recesses 386, 388 and 390.

The first recess 386 coincides with one limit position of disk-like element 332 and wherein cam 374 has displaced switch element 372 of switch 370 in a direction so as to energize motor 46.

In such limit position 386 dogs 314, 316 of clutch element 318 are urged upwardly out of registration with recesses 310, 313 and gear wheel 292 under the force of spring element 322 whereby no rotation can be imparted to rotary shaft section 260 and brush 44.

In the second or intermediate position 388, cam 374 releases switching element 372 which de-energizes motor 46 and wherein neither centrifugal fan 40 nor brush element 44 are rotated.

In the third position 390 which coincides with the other limit position of disk-like element 332 cam 374 displaces switching element 372 to energize motor 46 and in such position dogs 314, 316 have been fully registered within recesses 310, 312 under the descent of clutch element 318 so as to impart rotation to the brush 44 through rotary shaft section 260 and to impeller 50 of the centrifugal fan 40 by motor shaft 48 and associated coupling 309, all as earlier described.

Thus it may be understood that in the first or limit position 386 of the knob-like element or control 338 the motor is energized to operate the fan 40.

In the third or limit position 390, knob-like element or control 338 energizes the motor to operate both the rotary brush 44 and the centrifugal fan 40.

In the second or intermediate position 388 the switch element 372 is released and the motor is de-energized or "off".

It has been a consideration in providing such a combination of centrifugal fan 40 and rotary brush 44 driven by the same motor 46 in the arrangement outlined that in order to accomplish a substantially immediate changeover from the operation of the fan 40 in the first position 386 to generate vacuum take up of fluids to the operation of both the fan 40 and the rotary brush 44 in the third position 390 passing through the second or "off" position 388 that a braking device 392 to retard and stay the rotation of motor shaft 48 be provided.

Such braking device 392 is revealed particularly in FIG. 10 in elevation, and to some extent revealed by FIG. 7.

Braking device 392 includes a brake pad holder 394 pivotally mounted centrally upon support formation 306 above base element 262 to swing about a pivot 396.

Brake pad holder 394 is provided with a brake pad 398 adapted to frictionally engage motor shaft 48 and worm gear shaft 300 in the region of coupling 309 so as to retard rotation immediately the motor 46 is de-energized by switching element 372.

A spring element 400 wound helically about pivot 396 and presenting arms 402 and 404 to bear against base element 262 and arm portion 406 of brake pad holder 394 normally urges brake pad 398 into engagement with coupling 309.

It is imperative that such braking load be removed from coupling 309 following the changeover to limit position 386, the mode in which fan 40 is operated or to the limit position 390, the mode in which fan 40 and rotary brush 44 are operated.

This is accomplished by providing support structure 306 with a vertical slot 408 within which displaceable cam 410 is disposed to bear downwardly against arm portion 406 of brake pad holder 394 and so displace arm portion 406 upwardly.

Downward displacement of displaceable cam 410 is accomplished by appropriate contouring of the perimetral undersurface of disk-like member 332 at 412 such that upon bringing stop 380 into registration with recess 388 displaceable cam 410 is urged uppermost by the arms of spring element 400 and the brake pad 398 urged into engagement with coupling 309.

In all other positions of disk-like element 332 the contour of the perimetral undersurface ensures that displaceable cam 410 bears against the arm 406 of brake pad holder 394 pivoting same about pivot 396 to release and hold brake pad 398 from contacting coupling 309.

Thus can the rotation of motor shaft 48 be retarded or braked and stopped so as to aid in the changeover from one operating mode to the other quickly and thereby avoid inflicting damage upon the gear chain for imparting rotation to the brush.

Recess or cavity 58 presented by rear casing cover 30 at rearward corner 413 and opening upwardly is defined by mating depending surrounding upper wall segment 414 and upwardly projecting surrounding lower wall segment 416 with recess 58 terminating lowermost in an integral downwardly inclined channel formation 418 to drain towards rear discharge opening 420.

The insertible removable container or capsule 60 adapted to register and seat therewithin is comprised of an upper generally cylindrically shaped hollow component 421 provided with a central discharge opening 422, the surrounding perimeter thereof serving as a seat for valve head 423 supported therebelow from a somewhat tube shaped element 424, the upper part thereof telescoping upwardly over the lower end of hollow component 421 and is provided with an inner perimetral projection or bead 426 which registers within the outer perimetral recess 428 presented by hollow component 421.

Mounted centrally of valve head 423 and extending centrally upwardly within hollow component 421 is a tube 430 adapted to deliver atmospheric air into the upper portion of the capsule as the fluid contents are depleted in order that the fluid can be dispensed under gravity through lower discharge opening 422.

Valve head 423 is carried within an integral yieldable support structure 432 derived from a suitable plastic such as polyethylene or other suitable yieldable material and extends inwardly of tube shaped element 424 and which normally urges same upwardly against the aforementioned valve seat.

Yieldable support structure 432 includes a deformable section 434 of reduced thickness to achieve the desired degree of flexibility.

Upon displacement of valve head 423 under the urging of post-like projection 440 presented by lever formation 64, valve head 423 is displaced from the full sealing closed position illustrated in FIG. 14 to the offset open position illustrated in FIG. 16 whereupon fluid within capsule 60 can drain through lower discharge opening 422 by way of radially spaced opening 462 in support structure 432 into rearwardly inclined channel formation 418 and conducted to rear discharge opening 420 and dispensed onto the surface to be cleaned.

Lever formation 64 includes a yoke formation 444 connected as at 446 to a vertically extending rod 448 terminating upwardly in a button formation 450 supporting an L-shaped element 452 extending therebelow which presents post-like projection 440 upwardly from the lowermost end thereof for actuating valve 62.

The arms 454 and 456 of yoke formation 444 embrace the mating wall segments 414 and 416 defining the recess wherein capsule 60 is inserted.

Wall segments 414 and 416 are provided in opposed regions of their mating edges opposed recesses 418*a*, 418*b* and 420*a*, 420*b* respectively to define a pair of aligned bearing openings when mated that serve to swingably support yoke formation 444 on the pivot formations 458, 460 respectively presented inwardly of the ends of yoke formation arms 454, 456 in the manner detailed in FIG. 15.

The lower mating wall segment 416 is slotted vertically as at 462 in order that the L-shaped element 452 can enter recess or cavity 58 below the capsule 60 and present the post-like projection 440 within the downwardly opening recess of the valve head 423.

Upon depressing button formation 450 downwardly, L-shaped lever element 452 is swung rearwardly about the axis defined by the pivot formations 458, 460 to move from the position shown in FIG. 14 to that of FIG. 16 to dispense the fluid from the capsule 60 as revealed by the arrows.

Operation

Apparatus 10 is provided with a handle formation 470 extending longitudinally centrally of rear end 14 bridging the separation between the forward upper contoured portion of fan chamber 236 of rear casing cover 30 and the upper rearward contoured portion thereof enclosing the mounting 54 for rotary brush 44 and presenting upwardly opening recess 58 for replaceable capsule 60 and through which knob-like element or operator 338 and centrally located fitting 346 for dislodging the brush 44 projects and as well presents button formation 450 for controlled dispensing of cleaning solution from capsule 60 upon the depression of same to activate the novel lever mechanism described.

An electric cable, not illustrated, carried by apparatus 10 for energizing the conventional circuit controlling the electric motor, also not illustrated, is provided with a suitable plug for connection to an appropriate electrical outlet.

When a liquid spill occurs the apparatus as constituted in FIG. 1 of the drawings, front end 12 fully assembled and connected to rear end 14, will be seized by handle formation 470 and the plug of electrical cable inserted in a suitable electrical outlet.

The knob-like element or operator 338 will be turned to the indicated "on" position to energize motor 46 to drive impeller 50 of centrifugal fan 40 only, which moves detent 380 as indicated in FIG. 13 so as to register with perimetral recess 386 of disk-like element 332 which swings cam 374 so as to bear against displaceable switch element 372 of electrical switch 370 located in the electric motor circuit to make the connection with the electrical source.

The rotation imparted through motor shaft 48 to impeller 50 draws air from the elongated circuitous passageway 20 into inlet opening 210 of impeller chamber 212 which is then delivered by peripheral openings 230 in shroud 228 to fan chamber 236 and discharged therefrom to the atmosphere through elongated spaced apertures 249 in the housing wall.

More particularly, air entering impeller chamber 212 through inlet opening 210 is drawn through apertures 216 of plate element 214 constituting the outlet 27 of elongated convoluted passageway 20 to thereby establish a pressure drop between orifice inlet 25 thereof and impeller chamber 212.

This pressure drop creates a low pressure or partial vacuum within second passageway section 147 and recovery chamber portion or holding tank 22.

The condition of low pressure or partial vacuum so created within passageway section 147 and associated recovery chamber portion or holding tank 22 by the continued operation of centrifugal fan 40 causes a strong stream of air to enter orifice 25 and accelerate up converging lower passageway portion 128 to the throat 132 thereof.

Such configuration of lower passageway portion 128 establishes a substantial local pressure drop in that region so that when inlet orifice 25 is presented to a liquid spill the fluid is accelerated into inlet orifice 25 along with the airstream and converging upwardly rearwardly along lower passageway section 128 some of the fluid is entrained as droplets in the airstream so established; and thereafter fluid and droplets are rapidly conveyed therewithin upwardly rearwardly through upper passageway portion 130 to an elevated region thereof where it reverses direction as it impinges upon the inner surface of the wall portion 99 and passes downwardly through apertures 136, 146 to again impinge upon the rearward surface of baffle formation 186 and diverted and directed thereby to move downwardly thereunder and then towards the lowermost end of second passageway section 147.

The increased volume of second passageway section as well as the volume of recovery chamber portion or holding tank 22 has the effect of reducing the velocity of the airstream traversing second passageway section 147 which coupled with the reversal from the initial direction taken by the airstream and fluid and entrained droplets as well as impingement upon the several surfaces presented by the second passageway section, the fluid coalesces and under gravity flows downwardly forwardly along the surrounding surfaces and collects upon upper surface of inclined wall segment 162 and then directed down the more sharply sloped upper surface of the lip formation 166 to enter the top opening or aperture 24 of recovery chamber portion or holding tank 22.

The surface of wall segment or lip formation 168 at the lower end of second passageway section 147 against which the directed airstream impinges also serves as a region for the collection of liquid and the coalescing of droplets entrained in the airstream and is so disposed as to direct same rearwardly downwardly under gravity to the top opening or aperture 24 where such fluid drains into the recovery chamber portion of holding tank 22.

The airstream stripped of the fluid droplets and devoid of fluid proceeds upwardly through apertures 174 and 176, defining the entrance into the third section into channel formations 178 and 180 and through upper rear exit openings 182 and 184 to enter the fourth section 100 at the top and is directed downwardly to outlet 27 and into the fan impeller chamber 220.

It will be understood that as the operation of apparatus 10 continues the recovered liquid or fluid accumulates within the recovery chamber portion or holding tank 22. The capacity of such a holding tank will vary but preferably will have the capacity of the order of 500 mL.

It is to be expected in manoeuvering apparatus 10 in taking up liquid spills that a wave action or sloshing will be generated in the fluid collected in chamber or tank 10. By so inclining lip formations 166, 168, as illustrated in FIG. 4, wave action or sloshing is dampened and the likelihood of the liquid escaping through the top inlet or aperture 24 by splashing or otherwise is minimized.

The collected fluid spill can be stored in the recovery chamber portion or holding tank 22, but, if it is to be emptied, operator 80 presented upwardly in rear end portion 14 is depressed to release latch bolt 72 to disengage the front end 12 of the rear 14 exposing the inner enclosure 18 which includes the tank 22, all as earlier described.

By removing the rear plug 472 from the rear wall 162 of the inner enclosure 18 the collected liquid or fluid can be discharged directly and plug 472 reinserted, the components reassembled and front end 12 reattached to rear end 14 all in the manner earlier described.

The operation of the rotary brush 44 in conjunction with motor 46 and fan impeller is achieved as earlier explained by switching the knob-like element 338 in a direction to register detent 380 in the perimetral recess 390 as indicated in FIG. 13.

As earlier outlined, by reason of the pivot axis defined by surface engagnng wheels 204, 206 upon application of the bristles of brush 44 to a surface to be cleaned the proboscis-like extension 126 of front end 12 will clear the supporting surface.

The Second Embodiment

The alternative preferred embodiment of the invention, generally designated at **10*a* in FIG. 17, like the first embodiment of FIGS. 1 to 16, inclusive, includes a separable front end 12*a* and rear end 14*a***.

The structure of such second or alternative embodiment differs from that of the first embodiment in several ways, particularly in relation to the shaping or configuration of the inner hollow enclosure **18*a* to accommodate an alternative interconnection with modified shell-like component 16*a* of the front end 12*a* to provide a straight push-fit type sealing engagement to establish a reproduceable substantially airtight joint at the junctures of first and second passageway sections; the inclusion within the housing of rear end 14*a* of a power source in the form of rechargeable batteries 500 and separately mounted motors 504, 506, respectively, for driving the exhaust fan or blower 40*a* and the rotary brush 44*a* and a modified mounting and gear arrangement for supporting the driven rotary brush 44*a*; and a modified structure for the capsule or container 60*a*** for storing and dispensing cleaning fluids or the like.

The parts or components of the second alternative embodiment illustrated in FIGS. 17 to 24, inclusive, that correspond to the same parts or components identified in the first embodiment of FIGS. 1 to 16, inclusive, have been given the same designation numbers followed by the letter "a" in order to utilize the written description of the structure and operation of such first embodiment in relation to the structure and operation of the alternative embodiment and introducing additional designation members only where there is a departure.

Modified inner hollow enclosure **18*a* snugly registers within cavity 21*a* of front end shell 16*a* through rear access opening 19*a*, and in mating relation therewith in order to establish the first three elongated sections of the generally convoluted internal passageway indicated by arrows 20*a*, with inlet orifice 25*a*** disposed forwardly thereof lowermost and therebelow.

Convoluted elongated internal passageway **20*a* of FIGS. 17 and 20, like the first embodiment, includes and communicates with intermediately located recovery chamber portion or holding tank 22*a* disposed therebelow and accessible only through a transversely extending preferably restricted top opening 24*a***.

Rear end section **14*a* likewise includes a hollow casing in two mating parts, including lower shell-like component or base 28*a* and upper shell-like component or cover 30*a***, each likewise derived from a suitable resilient opaque plastic such as polystyrene.

Rear end cover **30*a* and base 28*a* of the alternative embodiment when disposed in mating relation to define the rear housing 14*a* are likewise shaped to enclose and suitably support therewithin, as distinguished from the first embodiment, a power source centrally as indicated at 500 in FIG. 17 which includes in the preferred embodiment six sub C nickel cadmium rechargeable batteries rated 1.2 VDC at 120 mA per hour each, a centrally disposed centrifugal exhaust fan or blower 40*a* foremost driven by electric motor 504 extending horizontally centrally to be selectively energized by the power source 500, with electric motor 506 mounted to extend vertically also to be selectively energized by the power source 500 to drive rotary brush 44*a* through gear train 54*a*, supported upon an apertured mounting 42*a* presented by base section 28*a*** at the rear.

Motors 504 and 506 are adapted to be energized by means of a suitable switch mechanism **56*a* shown in FIG. 17** of the drawings.

Rear end cover portion **30*a* rearmost, like the first embodiment of FIGS. 1 to 16, is contoured to provide a rearwardly located upwardly opening recess or well 58*a* to releasably receive therewithin a replaceable generally cylindrically-shaped container or capsule 60*a* for a diluent or detergent solution, substantially as earlier described in relation to the first preferred embodiment, but with a modified dispensing valve structure 508 illustrated in FIGS. 22 and 23** of the drawings as will be more particularly described.

Rear end cover **30*a* and base 28*a* present, when mated, the requisite boss-like protuberance 66*a* bounded by perimetrally rearwardly extending wall portions 67*c***, 67d, matching the contour and dimensions of the inner surface 68a of trailing edge formation 69a of the shell-like component 16a of the front end 12a, so that upon entry therewithin in full registration wall portions 67c, 67d, snugly and sealingly engage inner surface 68a with trailing edge formation 69a seating against aligned radially extending shoulder formations 71c, 71d.

Rear section 14a is releasably secured to front end 12a in substantially the same manner as in the first embodiment by means of a spring-biased latch mechanism 70a, associated aperture 78a in segment 79a of trailing edge formation 69a, with segment 83a thereof having spaced apart apertures 84a, 86a, to receive and register with a pair of suitably contoured anchoring projections 88a, 90a.

Front End 12a

Front end outer shell 16a includes a bottom wall portion 102a, spaced apart upright side wall portions 104a, 106a, upwardly and rearwardly inclined forward wall portions 108a, 110a, respectively, intersecting as at 111a, and trailing edge formation 69a, all having a similar configuration and relationship to one another as in front end shell 16 of the first preferred embodiment.

Depending below inclined intersecting forward walls 108a, 110a, and spaced inwardly from the side edges thereof are opposed pairs of like elongated lower side wall segments 112a, 114a and like elongated upper side wall segments 116a, 118a, respectively, with lower side wall segments 112a, 114a converging upwardly to merge with upper side wall segments 116a, 118a which together with lower and upper inclined wall segments 120a, 122a joined thereto respectively define the first elongated section of the convoluted passageway 20a with the throat 132a intermediately thereof whose depth dimension compared to the first embodiment is somewhat reduced so as to decrease the overall cross-section and thereby increase the velocity of the air-stream drawn thereinto. The first elongated section includes at the elevated region thereof for maintaining the decreased overall crosssection spaced apart transversely extending baffle formation 507 depending from inclined forward wall 110a.

Front end shell 16a presents a transversely extending narrow orifice or inlet opening 126a forwardly lowermost in proboscis-like fashion.

According to this alternative embodiment vertically disposed wall portion 99a and horizontally disposed wall portion 134a of shell-like component 16a are both modified to present a tubular extension portion 510 extending sufficiently axially rearwardly so as to releasably register within a matching opening 509 provided with a suitable surrounding gasket 511 in an upstanding capsule-like enclosure portion 512 of upstanding modified inner hollow enclosure 18a in straight push-fit fashion whereby such structure assists in establishing the reproducible requisite airtight connection between the first and second sections of elongated passageway 20a upon displacement of hollow enclosure 18a forwardly in axial alignment as well as orients same as it moves into mating engagement within shell-like component 16a.

This straight push-fit type sealing connection is readily broken and the parts separated upon reverse axial displacement to accommodate disposal of the recovered spill or for cleaning out the components.

Front end hollow enclosure 18a includes a matching bottom wall portion 150a to wall portion 102a of front end housing 16a, spaced apart upright side wall portions 152a, 154a, upwardly and rearwardly extending intersecting inclined forward wall portions 158a, 160a, respectively, corresponding to forward wall portions 108a and 110a of front end shell component 16a and a horizontal wall portion 514 extending rearwardly below the tubular extension portion 510 of front end shell component 16a merging with the forward wall portion 516 of upstanding capsule-like enclosure portion 512 which is further defined by forward inclined wall portion 518, top wall portion 520 and rear wall portion 522 and terminating lowermost in rear wall portion 98a with a supporting wall segment 524 inclined forwardly and downwardly therebetween and bounded at the sides by opposed spaced apart wall portions 526, 528.

The walls of modified front end enclosure 18a are united along their respective abutting perimetral edges to give an overall shape which substantially matches or falls within the inner boundaries of cavity 21a presented by front end housing 16a.

Front end hollow enclosure 18a so defined is likewise provided with a downwardly inclined internal wall segment 162a extending forwardly of and supported from rearwardly disposed wall segment 524 and from side wall portions 152a and 154a and presenting a lip formation 166a lowermost in opposed spaced relation to wall segment or baffle 168a projecting rearwardly.

The separation between wall segment 168a and lip formation 166a define a restricted aperture 24a leading into the recovery chamber portion or holding tank 22a at the lowermost extent of the second section of the passageway 20a.

More particularly, as best seen in FIG. 20, having regard to inner hollow component 18a, the lower forwardly inclined wall portion 158a in the upper region thereof and upper forwardly inclined wall portion 160a, and upper horizontal wall 514 in the regions at either side are recessed as at 178a, 180a, bounded lowermost by inclined forward wall portions 530, 532, and innermost by vertically extending wall portions 534, 536, respectively and include opposed apertures 174a, 176a, therein, constituting the entrance to the third section of elongated passageway 20a.

When confined within shell component 16a recesses 178a, 180a, together with the enclosing respective wall portions of the front end shell 16a define the third section of passageway 20a.

The transverse extent of forwardly inclined wall portion 158a, in the upper region thereof, upper forwardly inclined wall portion 160a, and the horizontal wall portion 514 in the forward regions thereof substantially correspond to the transverse extent between elongated side wall portions 116a, 118a, of the shelllike component 16a.

The third section of passageway 20a communicates with fourth section 100a in the upper region thereof through open ends 182a, 184a, so defined when the hollow enclosure 18a is fully registered within the shell component 16a.

Rear End 14a

The lower casing or base 28a of rear end 14a is shaped in a similar manner to the lower casing or base 28 of rear end 14 of the first embodiment.

Centrifugal fan 40a in this embodiment however can be mounted centrally forwardly within and secured to casing base 28a with wall portions 67c, 67d, of protuberance 66a presenting a central opening 538 in alignment with and forwardly of central inlet opening 540 of fan housing 208a.

Inlet opening 540 of fan housing 208a is provided with a surrounding recess 542 wherein a suitable open cell foam filter 544 is releasably secured for removal to clean same or for replacement.

Open cell foam filter 544 is selected so as to pass the requisite volume of air therethrough and so meet performance standards, yet trap hair, carpet fibers, or any other debris carried through the convoluted passageway portion 20a to the inlet opening 540.

Fan housing 208a is provided with a suitable opening 244a through which motor shaft 48a of motor 504 extends. Motor shaft 48a is splined in the forward region thereof so that impellar 50a can be suitably pressed thereon and sufficiently gripped or anchored to hold same in position against separation.

Brush element 44a, as in the first embodiment of the appliance, is so disposed as to project below and partly outwardly beyond adjacent lower rear corner 256a of casing base portion 28a.

Mounting 42a for rotary brush element 44a is supported upon an apertured molded base element 262a secured by means of suitable threaded fasteners 546 within rear casing base section 28a upon an apertured boss formation 548.

Molded base element 262a includes an integral centrally depending tubular extension 264a serving as a bearing support for brush drive gear 550 and associated shaft portion 552 depending centrally therewithin with associated shaft portion 552 terminating lowermost in a compressible resilient nipple formation 272a.

Rear casing base section 28a in the region of rear corner 256a is appropriately contoured on the underside as at 268a to provide a recess wherein the bristle supporting block 270a of brush 44a is partly housed with block 270a releasably secured to the lowermost end of shaft 552 of brush drive gear 550 by means of nipple formation 272a.

Nipple formation 272a includes opposed spaced apart, generally longitudinally extending spaced apart sections 554, 556, of generally opposite symmetry which are adapted to yield inwardly towards each other so as to compressibly fit within central opening 278a of block 270a and extend therethrough with the lowermost extent thereof each presenting an opposed enlarged bead or ridge 558, 560, to the underside of block 270a upon release whereby a pressure fit therebetween is achieved such that rotation of brush drive gear 550 is imparted to block 270a and hence brush 44a.

Further, central opening 278a is provided with circumferentially transversely extending flanges 553 lowermost thereof, over which longitudinally extending ridges 558, 560 of nipple formation 272a extend to clasp same upon urging block 270a upwardly onto plug 272a until secured in full registration thereto.

Separation of block 270a from plug 272a is accomplished by pressing block 270a downwardly to contain spaced apart sections 548, 550, inwardly to release beads 558, 560, from engagement with the lower circumference of central opening 278a. A rib 564 lowermost of block 270a extends circumferentially outwardly therearound so as to facilitate the gripping of block 270a for attachment or release.

Block 270a is also provided upon the upper surface thereof with a centrally located annular ridge 566 of such diameter as to substantially encircle tubular extension 264a of molded base element 262a.

Molded base element 262a further includes part annular upstanding surrounding wall portion 568, enclosing gear mechanism 54a and supporting an upper platform 570 thereabove and secured thereto by fasteners 572.

Upper platform portion 570 includes an upstanding surrounding annular wall formation 574 having a diameter to receive therein and support the lower cylindrically shaped portion of motor 506 in telescoping fit which is anchored therein by suitable threaded fasteners.

Motor shaft 576 of motor 506 projects vertically downwardly through central aperture 578 of upper platform portion 570, and is splined lowermost to engage within the central opening of drive motor pinion gear 580.

Upper platform portion 570 also presents a tubular extension 582 downwardly therefrom to one side wherein depending reduction gear 584 is journalled.

Depending part tubular extension 586 is configured so as to accommodate reduction gear 584 to mesh with with pinion gear 580 and drive gear 550 carried by depending drive shaft 552 lowermost in the preferred embodiment. Further, the lower edge of depending part tubular extension 586 prevents upward movement imparted to drive gear 550 and associated shaft portion 552 upon contact of rotary brush element 44a to the surface to be cleaned.

Reduction gear 584 is mounted for rotation upon axle 588 secured uppermost within boss 582 of upper platfom 570 and lowermost within base element 262a.

Motors 504 and 506 are selectively powered by power source 500, comprised of six sub C nickel cadmium rechargeable batteries rated at 1.2 VDC at 120 mA per hour each. Power source 500 is intended to provide the requisite power to drive the apparatus for at least 12 minutes running time at full load with fully charged batteries. Recharging time for such batteries is approximately 14 to 16 hours from the fully discharged state.

FIG. 24 shows a schematic drawing of the wiring of the power source 500 to the motors 504 and 506.

Switch element 56a in the upper cover portion 30a is activated to switch from a first position to connect the power source 500 to motor 504 with the intermediate second position the off position, and the third position to connect the power source 500 to motor 506.

Essentially the single circuit includes the sub C nickel cadmium rechargeable batteries 590, a first resistor 592, having resistance of the order of 680 ohms, and a second resistor 594, having a resistance of the order of 10 ohms. In series with the first resistor 592 is a light emitting diode 596 to indicate when the power source 500 is being recharged. An IN4006 GI diode 598 is included to direct the current in the recharging batteries 590.

A suitable socket 600 receives an adaptor 602 for recharging the power source 500 through a conventional AC socket.

Recess or cavity 58a presented by rear casing cover 30a at rearward corner 413a of the modified embodiment of the apparatus opens upwardly and is likewise defined by mating depending surrounding upper wall segment 414a and upwardly projecting surrounding lower wall segment 416a, with recess 58a terminating lowermost in an integral downwardly inclined channel formation 418a to drain towards rear discharge opening 420a.

The insertible removable container or capsule 60a is comprised of an upper generally cylindrically-shaped hollow component 421a provided with a central discharge opening 422a, the surrounding perimeter thereof serving as a seat for valve head 423a supported therebelow from a somewhat cone-shaped element 424a by means of helical spring 602. The upper part of cone-shaped element 424a telescopes upwardly over the lower end of hollow component 421a and is provided with an inner perimetral projection or bead 426a which registers within the outer perimetral recess 428a presented by hollow component 421a, all as described for the first preferred embodiment. In addition, cone-shaped element 424a presents circumferentially spaced apart rib elements 604 which are adapted to support the lower end of hollow component 421a presented thereabove.

Hollow component 421a also provides uppermost thereof an indentation, as at 606, which extends circumferentially therearound and is provided with rib segments 608 therein so as to facilitate the gripping of container or capsule 60a for ready removal or insertion of same within recess 58a.

Helical spring 602 normally urges valve head 423a upwardly against the aforementioned valve seat. Upon displacement of valve head 423a under the urging of post-like projection 440a presented by lever formation 64a, valve head 423a is displaced from the full sealing closed position illustrated in FIG. 22 to the offset open position illustrated in FIG. 23, whereupon fluid within capsule 60a can drain through lower discharge opening 422a through central aperture 610 located lowermost in cone-shaped element 424a into rearwardly inclined channel formation 418a and conducted to rear discharge opening 420a and dispensed onto the surface to be cleaned, all as described as in the first preferred embodiment.

Apart from the difference in the particular configuration of components of the second embodiment compared to the first and the aspect of patentability which is conferred upon the second embodiment by the incorporation of the power source 500 and equipping the unit with requisite motors the second embodiment is operated and intended to be used in the manner described in relation to the first embodiment.

While two preferred embodiments have been described and illustrated, variations in the structure embodying the invention may be undertaken by those persons skilled in this field without departing from the spirit and scope of the invention as set forth in the appended claims.

What we claim is:

1. In a vacuum surface cleaning apparatus an elongated passageway having an inlet at one end and an outlet at the other end and a recovery chamber portion having a top opening therein in communication with said elongated passageway intermediately of the extent thereof, said elongated passageway including a first section extending from said inlet to an elevated region thereof remote from said inlet and above said recovery chamber portion, an intermediate section in communication with said first section in said elevated region thereof and extending therefrom to overlie and communicate with said top opening of said recovery chamber portion with the flow path cross sectional area of said intermediate section exceeding the flow path cross sectional area of said first section, and a third section in communication with said intermediate section in the region thereof above said top opening and extending therefrom toward said outlet.

2. In a vacuum surface cleaning apparatus for taking up and recovering liquids including a recovery chamber portion having a top opening therein and an elongated passageway having an inlet at one end and an outlet at the other end and being in communication with said recovery chamber portion through said top opening in a region thereof intermediately between said inlet and said outlet, said elongated passageway including a first section extending upwardly from said inlet to an elevated region thereof remote from said inlet and above and beyond said top opening of said recovery chamber portion, an intermediate section communicating with said first section in said elevated region thereof and extending downwardly reversely therefrom to overlie said top opening and with the flow path cross sectional area of said intermediate section exceeding the flow path cross sectional area of said first section, and a succeeding section communicating with said intermediate section in the region thereof above said top opening and extending therefrom toward said outlet.

3. In a vacuum surface cleaning apparatus for taking up and recovering liquids including a recovery chamber portion having a top opening therein and an elongated passageway having an inlet at one end and an outlet at the other end and being in communication with said recovery chamber portion through said top opening in a region thereof intermediately between said inlet and said outlet, said elongated passageway including a first section extending upwardly and rearwardly from said inlet disposed forwardly of said recovery chamber portion to an elevated region thereof remote from said inlet above and beyond said top opening of said recovery chamber portion, an intermediate section communicating with said first section in said aforementioned elevated region of said first section and extending downwardly forwardly therefrom to overlie said top opening and a succeeding section communicating with said intermediate section in the region thereof above said top opening and extending rearwardly therefrom toward said outlet.

4. In a vacuum surface cleaning apparatus for taking up and recovering liquids including a recovery chamber portion having a top opening therein and an elongated convoluted passageway having an inlet at one end and an outlet at the other end and being in communication with said recovery chamber portion through said top opening in a region thereof intermediately between said inlet and said outlet, said elongated convoluted passageway including a first section extending upwardly and rearwardly from said inlet to an elevated region thereof remote from said inlet above and beyond said top opening, an intermediate section communicating with said first section in said elevated region thereof and extending downwardly forwardly therefrom to overlie said top opening, a succeeding section communicating with said intermediate section in the lowermost region thereof and above said top opening and extending upwardly rearwardly therefrom to an elevated region thereabove and a still further succeeding section communicating with said third section in said elevated region thereof and extending downwardly therefrom to said outlet.

5. Apparatus according to claims 1, 2, 3 or 4 wherein said first section of said elongated passageway converges from said inlet towards a region intermediately of the extent thereof so as to define a constricted throat portion therein.

6. Apparatus according to claims 1, 2, 3 or 4 wherein said intermediate section of said elongated passageway is in communication with said top opening of said recovery chamber portion through the lowermost region thereof.

7. Apparatus according to claims 1, 2, 3 or 4 wherein said intermediate section of said elongated passageway is downwardly sloped from the region thereof in communication with said first section to the region thereof in communication with said top opening into said recovery chamber portion.

8. Apparatus according to claims 1, 2, 3 or 4 wherein said intermediate section of said elongated passageway includes depending baffle means therein in the region thereof upstream from said top opening and of an extent and in a disposition to thereby direct and divert recovered liquids impinging thereon towards said top opening.

9. Apparatus according to claims 1, 2, 3 or 4 wherein said intermediate section of said elongated passageway includes baffle means in the region thereof adjacent to and downstream of said top opening and extending thereabove and thereacross so as to direct and divert recovered liquids impinging thereon towards said top opening.

10. Apparatus according to claims 1, 2, 3 or 4 wherein said intermediate section of said elongated passageway includes first depending baffle means therein in the region thereof upstream of said top opening and second depending baffle means therein in the region thereof adjacent to and downstream of said top opening and with said respective baffle means having an extent and in a disposition to thereby respectively direct and divert impinging recovered liquids towards said top opening.

11. Apparatus according to claims 3 or 4 wherein the flow path cross-sectional area of said intermediate section of said elongated passageway substantially exceeds the flow path cross-sectional area of said first section thereof.

12. Apparatus according to claims 1, 2, 3 or 4 wherein the portion of said first section of said elongated passageway leading from said inlet converges from said inlet towards a region thereof intermediately between said inlet and said elevated region thereof so as to define a constricted throat portion therein with the upper portion of said first section after said constricted throat portion having a substantially constant cross-section extending therefrom to said elevated region.

13. Apparatus according to claims 1, 2, 3 or 4 wherein the portion of said first section of said elongated passageway leading from said inlet converges from said inlet towards the region intermediately between said inlet and said elevated region thereof so as to define a constricted throat portion therein, and with the portion of said first section after said constricted throat portion having a substantially constant cross-section extending therefrom to said elevated portion thereof and said intermediate section in the region thereof communicating with and adjacent to said first section having an increased cross-sectional area in relation to said elevated region of said first section and converging therefrom toward the region of said second section remote from said first section in communication with said top opening.

14. Apparatus according to claims 1, 2, 3 or 4 wherein said inlet presented by said elongated passageway has a configuration wherein the length substantially exceeds the width so as to define a narrow elongated orifice and the portion of said first passageway section leading from said narrow elongated orifice converges downstream therefrom to define a constricted throat portion therein whereby under the application thereto of a vacuum generating source liquids are accelerated from said elongated orifice downstream therealong.

15. Apparatus according to claims 1, 2, 3 or 4 wherein said several sections of said elongated passageway and said recovery chamber portion have a fixed relative disposition to one another and said inlet is presented beyond and below said recovery chamber portion in proboscis-like fashion.

16. Apparatus according to claims 1, 2, 3 or 4 wherein said first section of said elongated passageway overlies said intermediate section and said succeeding section thereto extends between said first and intermediate sections thereof and said inlet is presented forwardly beyond and below said recovery chamber portion in proboscis-like fashion.

17. Apparatus according to claims 1, 2, 3 or 4 wherein said first section of said elongated passageway overlies said intermediate section and said succeeding section thereto extends between said first and intermediate sections thereof, said inlet being presented forwardly beyond and below said recovery chamber portion in proboscis-like fashion and said outlet is disposed rearwardly beyond said recovery chamber portion.

18. Apparatus according to claims 1, 2, 3 or 4 wherein said top opening of said recovery chamber portion has a configuration wherein the length substantially exceeds the width so as to define an elongated narrow entrance thereinto from said intermediate section, with the length thereof disposed to extend at substantially right angles to the flow path direction of said intermediate section.

19. In a vacuum surface cleaning apparatus for taking up and recovering liquids including a recovery chamber portion having a top opening therein and an elongated convoluted passageway having an inlet at one end and an outlet at the other end and being in communication with said recovery chamber portion through said top opening in a region thereof intermediately between said inlet and said outlet, said elongated convoluted passageway including a first inclined section extending upwardly and rearwardly from said inlet to an elevated region thereof remote from said inlet above and beyond said top opening, an intermediate inclined section communicating with said first section in said aforementioned elevated region of said first section and extending downwardly forwardly therefrom to overlie said top opening, a succeeding inclined section communicating with said intermediate section in the lowermost region thereof and above said top opening and extending upwardly rearwardly therefrom to an elevated region thereabove and a still further succeeding section communicating with said succeeding section in said elevated region thereof and extending downwardly therefrom to said outlet spaced rearwardly from said recovery chamber portion with said first section of said elongated passageway converging from said inlet towards a region downstream and intermediately of the extent thereof so as to define a constricted throat portion therein whereby under the application to said outlet thereof of a vacuum generating source liquids are accelerated from said inlet downstream therealong for discharge into said recovery chamber portion, and wherein said intermediate inclined section of said elongated passageway is in communication through the lowermost region thereof with said top opening of said recovery chamber portion.

20. Apparatus according to claim 19 wherein said inlet presented by said elongated passageway has a configuration wherein the length substantially exceeds the width so as to define a narrow elongated orifice and is presented forwardly beyond and below said recovery chamber portion in proboscis-like fashion.

21. Apparatus according to claim 20 wherein said top opening of said recovery chamber portion has a configuration wherein the length substantially exceeds the width so as to define an elongated narrow entrance thereinto with the length thereof disposed to extend generally at right angles to the flow path direction of said intermediate section and thereacross lowermost therebelow.

22. Apparatus according to claim 21 inclusive wherein the flow path cross-sectional area of said intermediate section of said elongated passageway substantially exceeds the flow path cross-sectional area of said first section of said elongated passageway.

23. In a vacuum surface cleaning apparatus wherein an elongated passageway having an inlet at one end and an outlet at the other end comprises several succeeding sections with a recovery chamber portion having an opening thereinto in communication with an intermediate section thereof, a shell-like outer component which includes at least the first section of said elongated passageway and a mated hollow inner component nested within and separable from said shell-like outer component which includes an intermediate section of said, elongated passageway and said recovery chamber portion therewithin, said mated hollow inner and shell-like outer component having a configuration and extent so as to define when mated a succeeding section of said elongated passageway therebetween.

24. In a vacuum surface cleaning apparatus wherein an elongated passageway having an inlet at one end and an outlet at the other end comprises several succeeding sections with a recovery chamber portion having an opening thereinto in communication with an intermediate section thereof, a front end comprising a shell-like outer component which includes at least the first section of said elongated passageway and a mated hollow inner component nested within and separable from said shell-like outer component which includes an intermediate section of said elongated passageway and said recovery chamber portion therewithin, said mated hollow inner and shell-like outer component having a configuration and extent so as to define when mated a succeeding section of said elongated passageway therebetween and a rear end including a shell-like enclosure interengagable with and separable from said shell-like outer component of said front end so as to expose said mated separable hollow component nested therewithin with said front and rear end in their regions of interengagement having a configuration and extent so as to define a further succeeding section of said elongated passageway therebetween.

25. In a vacuum surface cleaning apparatus for taking up and recovering liquids wherein an elongated convoluted passageway comprises at least three discrete succeeding sections including a first section with an inlet followed by an intermediate section and a succeeding section leading from said intermediate section to an outlet and a liquid recovery chamber portion having a top opening therein in communication with the lowermost region of said intermediate section, a shell-like outer component and a separable mating hollow inner component, said shell-like outer component presenting a cavity with an access opening thereinto for the entry and withdrawal of said separable mating hollow inner component defined by top, side and bottom wall portions extending forwardly from said access opening, said upper wall portion of said shell-like outer component inclining upwardly rearwardly from the foremost extent of same to an elevated region thereabove and including said first section of said elongated passageway therein extending from said inlet presented foremost in the region of said bottom wall portion thereof to said elevated region, said separable mating hollow inner component including top, side, bottom and rear wall portions defining a hollow enclosure, said top, side and bottom wall portions of said hollow component having a configuration and extent generally matching the configuration and extent of the inner surfaces presented by said cavity of said shell-like outer component so as to nest snugly therewithin when mated, said inner hollow component including said intermediate section of said elongated passageway and said liquid recovery chamber portion therewithin, and with at least one of said adjacent top and side wall portions of said shell-like outer component and separable mating hollow inner component having a configuration so as to defined when mated said succeeding section to said intermediate section of said elongated passageway.

26. In a vacuum suface cleaning apparatus for taking up and recovering liquids wherein an elongated passageway having an inlet at one end and an outlet at the other end comprises at least several succeeding sections with a liquid recovery chamber portion having a top opening thereinto in communication with said second section thereof and disposed therebelow, a front end comprising a shell-like outer component which includes the first section of said elongated passageway and a mated hollow inner component nested within and separable from said shell-like outer component which includes the intermediate section of said elongated passageway and said liquid recovery chamber portion therewithin, said mated hollow inner and shell-like outer component having a configuration and extent so as to define when mated the succeeding third section of said elongated passageway therebetween and a rear end including a shell-like enclosure interengaging with and separable from said shell-like outer component of said front end so as to expose said mated separable hollow component nested therewithin, with said shell-like outer component and respective mated hollow inner component and shell-like enclosure of said front and rear ends in their region of interengagement having a configuration and extent so as to define the succeeding fourth section of said elongated passageway therebetween.

27. In a vacuum surface cleaning apparatus for taking up and recovering liquids wherein an elongated passageway having an inlet at one end and an outlet at the other end comprises at least three succeeding sections with a liquid recovery chamber portion having a top opening thereinto in communication with an intermediate section thereof and disposed therebelow, a shell-like outer component which includes said first section of said elongated passageway and a mated hollow inner component nested within and separable from said shell-like outer component which includes said intermediate section of said elongated passageway and said liquid recovery chamber portion therewithin, with said mated inner and outer components having a configuration and extent so as to define when mated said succeeding third section of said elongated passageway therebetween.

28. Apparatus according to any one of claims 19, 27, 28, 30, or 31 inclusive, wherein said first section of said elongated passageway overlies said intermediate section thereof and said succeeding section thereto extends adjacent said first and intermediate sections.

29. Apparatus according to any one of claims 23, 24, 25, 26 or 27, inclusive, wherein said inlet of said elongated passageway is disposed forwardly of and below said recovery chamber portion.

30. Apparatus according to any one of claims 19, 23, 24, 25, 26 or 27 inclusive, wherein said first section of said elongated passageway extends from said inlet to an elevated region thereabove and beyond said top opening of said recovery chamber portion.

31. Apparatus according to any one of claims 19, 23, 24, 25, 26 or 27 inclusive, wherein said intermediate section of said elongated passageway is sloped downwardly from the region in communication with said first section to the region thereof in communication with said top opening of said recovery chamber portion.

32. Apparatus according to any one of claims 19, 23, 24, 25, 26 or 27 inclusive, wherein said intermediate section of said elongated passageway includes depending baffle means therein in the region thereof upstream from said top opening and of an extent and in a disposition to thereby direct and divert recovered liquids impinging thereon towards said top opening.

33. Apparatus according to any one of claims 19, 23, 24, 25, 26 or 27 inclusive, wherein said intermediate section of said elongated passageway includes baffle means in the region thereof adjacent to and downstream of said top opening of said recovery chamber portion and extending thereabove and thereacross so as to direct and divert recovered liquids impinging thereon towards said top opening.

34. Apparatus according to any one of claims 19, 23, 24, 25, 26 or 27 inclusive, wherein said intermediate section of said elongated passageway includes first depending baffle means therein in the region thereof upstream of said top opening and second depending baffle means therein in the region thereof adjacent to and downstream of said top opening and with said respective baffle means having an extent and in a disposition to thereby respectively direct and divert impinging recovered liquids towards said top opening.

35. Apparatus according to any one of claims 19, 23, 24, 25, 26 or 27 inclusive, wherein the portion of said first section of said elongated passageway leading from said inlet converges from said inlet towards a region thereof intermediately between said inlet and said elevated region thereof so as to define a constricted throat portion therein with the upper portion of said first section after said constricted throat portion having a substantially constant cross-section extending therefrom to said elevated region.

36. Apparatus according to claim 26 or 27 wherein the flow path cross-sectional area of said intermediate section of said elongated passageway substantially exceeds the flow path cross-sectional area of said first section.

37. Apparatus according to claim 36 wherein said intermediate section from the region communicating with and adjacent to said first section converges therefrom toward the region thereof in communication with said top opening of said recovery chamber portion.

38. Apparatus according to claim 37 wherein said inlet presented by said elongated passageway has a configuration wherein the length substantially exceeds the width so as to define a narrow elongated orifice.

39. Apparatus according to claim 30 wherein said top opening of said recovery chamber portion has a configuration wherein the length substantially exceeds the width so as to define an elongated narrow entrance thereinto, with the length thereof disposed to extend at substantially right angles to the flow path direction of said intermediate section and lowermost thereof and therebelow.

40. Apparatus according to claim 39 wherein said succeeding sections of said elongated passageway and said recovery chamber portion have a fixed relative disposition to one another when said shell-like outer component and said hollow inner component are mated and wherein said inlet is presented beyond said mated components and below said recovery chamber portion in proboscis-like fashion.

41. Apparatus according to claim 40 wherein said outlet is disposed rearwardly beyond said recovery chamber portion.

42. Apparatus according to claim 41 wherein vacuum generating source means are connected to said outlet for exhausting air from said elongated passageway and from said recovery chamber portion to create a pressure drop between said inlet and outlet thereof so as to accelerate matter to be recovered into said inlet and convey same downstream therealong and into said top opening of said recovery chamber portion.

43. Apparatus according to claim 42 wherein said vacuum generating means includes centrifugal fan means and associated motor means for driving same, said motor means including motor shaft means extending outwardly therefrom and means for coupling said motor shaft means to said centrifugal fan means to drive same.

44. Apparatus according to claims 24 or 26 wherein said shelllike enclosure of said rear end includes an upstanding forward housing portion and an upstanding rearward housing portion, said upstanding forward housing portion enclosing centrifugal fan means therein having an inlet and an outlet with said shell-like enclosure in said region of interengagement with said shell-like component of said front end including aperture means therethrough communicating with said outlet of said elongated passageway and said centrifugal fan means inlet, with said shell-like enclosure in a region thereof remote from said region of interengagement having aperture means therethrough for communication between said centrifugal fan means outlet and the atmosphere.

45. Apparatus according to claims 24 or 26 wherein said shell-like outer component of said front end includes a surrounding edge formation extending rearwardly beyond said separable mating hollow inner component when nested therewithin and said shell-like enclosure of said rear end presents a surrounding recessed shoulder formation forwardly thereof to said surrounding edge formation of said shell-like outer component of said front end and in snug sliding fit therewithin and sealing engagement thereagainst and catch means carried by said respective front and rear ends in the region of interengagement for releasably securing same together against separation.

46. In a vacuum surface cleaning apparatus for taking up and recovering liquids wherein an elongated convoluted passageway comprises a first section with an inlet, an intermediate second section, a succeeding section thereto and a fourth section leading to an outlet and a liquid recovery chamber portion having a top opening therein in communication with said intermediate second section of said elongated passageway in the lowermost region thereof, centrifugal fan means connected to said outlet for drawing air from said elongated passageway and said liquid recovery chamber portion to create a pressure drop between said passageway inlet and outlet, motor means including motor shaft means driving said centrifugal fan means, a shell-like outer component and a mated hollow inner component separable from said shell-like outer component, said shell-like outer component having an access opening thereinto for the passage of said inner hollow component therethrough and reversely said access opening being adapted to be disposed rearwardly and including top, side and bottom wall portions extending forwardly therefrom to thereby define a cavity for the nesting of said hollow inner component therewithin in mating registration, said upper wall portion of said outer shell-like component inclining upwardly rearwardly from the foremost extent of same and including said first section of said elongated passageway therein extending from said inlet presented forwardly lowermost in the region of said bottom wall portion thereof to an elevated region thereabove remote from said inlet and above and beyond said top opening of said recovery chamber portion and terminating in aperture means leading therefrom, and wherein the portion of said first section of said elongated passageway leading from said inlet converges from said inlet towards the region thereof intermediately between said inlet and said elevated region thereof so as to define a constricted throat portion therein, and with the portion of said first section after said constricted throat portion having a substantially constant cross-section and extending therefrom to said elevated region thereof, said hollow inner component including inlet aperture means leading thereinto arranged in aligned sealing engagement with said outlet aperture means of said first section when said separable components are mated, said hollow inner component including top, side, rear and bottom wall portions defining an enclosure disposed to extend generally forwardly of said inlet aperture means leading thereinto with said top wall portion thereof inclining forwardly downwardly for disposition below said top wall portion of said shell-like outer component, said hollow inner component including therewithin said second section of said elongated passageway and disposed below said top wall portion thereof and in communication with said inlet aperture means leading therein and in spaced relation above said bottom wall to thereby define said liquid recovery chamber portion therebelow, said second section of said elongated passageway leading from said inlet aperture means forwardly and downwardly and communicating lowermost with said top opening presented by said recovery chamber portion, said second section in the region adjacent to and communicating with said first section having an increased flow path cross-section in relation to said first section and converging therefrom toward the lowermost region of said second section, said upper wall portion of said inner hollow component having an aperture means therein in the region thereof above said top opening of said recovery chamber portion and communicating with said second section and serving as outlet means therefrom an inlet means into said third section, said shell-like outer component and said hollow inner component having a configuration in the region of said top and side wall portions thereof and so spaced apart when mated as to define said third section of said elongated passageway therebetween leading from said last mentioned aperture means to said access opening, and a fourth section communicating with said third section in the region of said access opening and extending downwardly therefrom to said outlet.

47. Apparatus according to claim 46 wherein said second section of said elongated passageway includes first depending baffle means therein in the region thereof upstream of said top opening and second depending baffle means therein in the region thereof adjacent to and downstream of said top opening and with said respective baffle means having an extent and in a disposition to thereby respectively direct and divert impinging recovered liquids towards said top opening.

48. Apparatus according to claim 47 wherein said first section of said elongated passageway overlies said second section and said third section thereof extends between said first and said second sections thereof, when said shell-like outer component and said hollow inner component are mated.

49. Apparatus according to claim 47 wherein said top opening of said recovery chamber portion has a configuration wherein the length substantially exceeds the width so as to define an elongated narrow entrance thereinto with the length thereof disposed to extend at substantially right angles to the flow path direction of said second section and lowermost thereof and thereacross.

50. Apparatus according to claim 49 wherein said recovery chamber portion includes outlet means therein remote from said top opening for discharging recovered liquids therefrom.

51. Apparatus according to claim 50 wherein said recovery chamber portion discharge outlet means includes releasably sealable aperture means.

52. In a method for taking up and recovering liquids the step of generating a gaseous stream so as to proceed through an inlet and along an upwardly rearwardly inclined first flow path, the step of reversing said gaseous stream when the uppermost region of the first flow path is reached so as to proceed along a downwardly forwardly inclined second flow path wherein the velocity thereof is so reduced as to substantially completely separate any entrained liquid from the gaseous stream followed by the step of again reversing the gaseous stream when the lowermost region of the second flow path is reached so as to proceed along an upwardly rearwardly inclined third flow path towards discharge, whereby the gaseous stream so generated from inlet to discharge is swung throughout at least 360° taken in the same direction.

* * * * *